US011600218B2

(12) United States Patent
Yokoyama et al.

(10) Patent No.: US 11,600,218 B2
(45) Date of Patent: Mar. 7, 2023

(54) LIGHT EMITTER BOARD, DISPLAY DEVICE, AND METHOD FOR REPAIRING DISPLAY DEVICE

(71) Applicant: KYOCERA Corporation, Kyoto (JP)

(72) Inventors: Ryoichi Yokoyama, Kakogawa (JP); Takanobu Suzuki, Itami (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 17/433,583

(22) PCT Filed: Jan. 6, 2020

(86) PCT No.: PCT/JP2020/000091

§ 371 (c)(1),
(2) Date: Aug. 24, 2021

(87) PCT Pub. No.: WO2020/174879

PCT Pub. Date: Sep. 3, 2020

(65) Prior Publication Data

US 2022/0139300 A1 May 5, 2022

(30) Foreign Application Priority Data

Feb. 26, 2019 (JP) ..... JP2019-032738
May 15, 2019 (JP) ..... JP2019-092002

(51) Int. Cl.
*G09G 3/32* (2016.01)
*G09G 3/00* (2006.01)

(52) U.S. Cl.
CPC ..... *G09G 3/32* (2013.01); *G09G 3/006* (2013.01); *G09G 2300/0842* (2013.01); *G09G 2310/0267* (2013.01); *G09G 2310/0272* (2013.01)

(58) Field of Classification Search
CPC .. G09G 3/32; G09G 3/006; G09G 2300/0842; G09G 2310/0267;
(Continued)

(56) References Cited

U.S. PATENT DOCUMENTS 8,581,271 B2 * 11/2013 Shikina ..... H01L 51/5275 257/89
9,129,923 B1 * 9/2015 Han ..... H01L 27/3262
(Continued)

FOREIGN PATENT DOCUMENTS

CN 101276528 A 10/2008
JP H8-137413 A 5/1996
(Continued)

*Primary Examiner* — Jose R Soto Lopez
(74) *Attorney, Agent, or Firm* — Procopio Cory Hargreaves and Savitch LLP

(57) ABSTRACT

A light emitter board includes a substrate having a mount surface on which first and second light emitters are mountable, and at least one pixel unit on the mount surface, including a drive circuit and first and second drive lines. The first drive line as a primary line and the second drive line as a redundant line are connected in parallel to the drive circuit. The pixel unit includes, on the mount surface, first positive and negative electrode pads connectable to the first light emitter, and second positive and negative electrode pads to the second light emitter. The first positive or negative electrode pad is connected to the first drive line, and the second positive or negative electrode pad to the second drive line.

14 Claims, 17 Drawing Sheets

(58) Field of Classification Search
CPC ... G09G 2310/0272; G09G 2300/0404; G09G 2300/0804; G09G 2300/0814; G09G 2300/0857; G09G 2330/12; G09G 3/3233; G09G 2330/08; G09G 2360/148; H04B 45/46; H04B 45/52; H04B 33/12; H04B 33/14
See application file for complete search history.

(56) References Cited

U.S. PATENT DOCUMENTS 9,852,683 B2 * 12/2017 Liu ..... G09G 5/10
10,181,284 B2 * 1/2019 Yin ..... G09G 3/3233
10,916,192 B2 * 2/2021 Pappas ..... G09G 3/3233
2002/0105279 A1 * 8/2002 Kimura ..... G09G 3/14 315/169.3
2003/0083843 A1 * 5/2003 Yamano ..... G09G 3/006 702/127
2003/0087476 A1 * 5/2003 Oohata ..... H01L 24/82 438/455
2006/0214888 A1 * 9/2006 Schneider ..... G09G 3/3233 345/76
2008/0042943 A1 * 2/2008 Cok ..... G09G 3/3225 345/77
2008/0062096 A1 * 3/2008 Yamashita ..... G09G 3/3233 345/82
2010/0073265 A1 * 3/2010 Hirai ..... G09G 3/325 345/55
2010/0128051 A1 * 5/2010 Mizuta ..... H05B 45/20 345/589
2010/0253715 A1 * 10/2010 Odawara ..... G09G 3/3233 445/3
2011/0043499 A1 * 2/2011 Cok ..... G09G 3/3208 345/82
2012/0154460 A1 * 6/2012 Segawa ..... H01L 27/3276 345/77
2013/0271811 A1 * 10/2013 Lam ..... G02B 5/23 359/266
2014/0319486 A1 * 10/2014 Hong ..... G09G 3/32 257/40
2015/0103070 A1 * 4/2015 In ..... G09G 3/3233 345/76
2016/0005383 A1 * 1/2016 Lee ..... G09G 3/3291 345/82
2016/0358533 A1 * 12/2016 Rotzoll ..... G09G 3/32
2017/0206839 A1 * 7/2017 Wu ..... G09G 3/3233
2017/0269398 A1 * 9/2017 Park ..... H01L 27/1244
2017/0270852 A1 * 9/2017 Meitl ..... G09G 3/32
2017/0316737 A1 * 11/2017 Park ..... G09G 3/3208
2018/0102465 A1 * 4/2018 Wang ..... H01L 33/62
2018/0182295 A1 * 6/2018 Ahmed ..... G09G 3/3233
2019/0005870 A1 * 1/2019 Son ..... H01L 25/0753
2019/0043842 A1 * 2/2019 Guo ..... H01L 25/0753
2019/0206300 A1 * 7/2019 Lee ..... H01L 27/3248
2019/0385513 A1 * 12/2019 Iguchi ..... G09F 9/00
2020/0126484 A1 * 4/2020 Yan ..... G09G 3/3258
2020/0152101 A1 * 5/2020 Li ..... G09G 3/30
2020/0152826 A1 * 5/2020 Lee ..... H01L 33/24
2020/0193883 A1 * 6/2020 Kao ..... G09G 3/3208
2020/0194370 A1 * 6/2020 Radauscher ..... H01L 23/528
2022/0157229 A1 * 5/2022 Ogawa ..... H01L 27/156

FOREIGN PATENT DOCUMENTS

JP 2008-65200 A 3/2008
JP 2019-28284 A 2/2019
WO 2018/116814 A1 6/2018

* cited by examiner

LIGHT EMITTER BOARD, DISPLAY DEVICE, AND METHOD FOR REPAIRING DISPLAY DEVICE

FIELD

The present disclosure relates to a light emitter board on which light emitters such as micro-light-emitting diodes (LEDs) are mountable, a display device including the light emitter board, and a method for repairing the display device.

BACKGROUND

A known light emitter board includes light emitters such as micro-light-emitting diodes (LEDs), and a known self-luminous display device that eliminates a backlight device includes the light emitter board. Such a display device is described in, for example, Patent Literature 1. The known display device includes a glass substrate, scanning signal lines extending in a predetermined direction (e.g., a row direction) on the glass substrate, emission control signal lines crossing the scanning signal lines and extending in a direction (e.g., a column direction) crossing the predetermined direction, an effective area (pixel area) including multiple pixel units defined by the scanning signal lines and the emission control signal lines, and multiple light emitters located on an insulating layer. The scanning signal lines and the emission control signal lines are connected to back wiring on the back surface of the glass substrate with side wiring on a side surface of the glass substrate. The back wiring is connected to driving elements such as integrated circuits (ICs) and large-scale integration (LSI) circuits mounted on the back surface of the glass substrate. In other words, the display in the display device is driven and controlled by the driving elements on the back surface of the glass substrate. The driving elements are mounted on the back surface of the glass substrate by, for example, chip on glass (COG).

Each pixel unit includes an emission controller to control, for example, the emission or non-emission state and the light intensity of the light emitter in an emissive area. The emission controller includes a thin-film transistor (TFT) as a switch for inputting a drive signal into the light emitter and a TFT as a driving element for driving the light emitter with a current using an electric potential difference (drive signal) between a positive voltage (anode voltage of about 3 to 5 V) and a negative voltage (a cathode voltage of about −3 to 0 V) corresponding to the level (voltage) of an emission control signal (a signal transmitted through the emission control signal lines). The connection line connecting the gate electrode and the source electrode of the TFT receives a capacitor, which retains the voltage of the emission control signal input into the gate electrode of the TFT until the subsequent rewriting is performed (for a period of one frame).

The light emitter is electrically connected to the emission controller, a positive voltage input line, and a negative voltage input line with feedthrough conductors such as through-holes formed through the insulating layer located in the effective area. In other words, the positive electrode of the light emitter is connected to the positive voltage input line with one feedthrough conductor and the emission controller, and the negative electrode of the light emitter is connected to the negative voltage input line with another feedthrough conductor.

The display device also includes a frame between the effective area and the edge of the glass substrate as viewed in plan. The frame, which does not contribute to display, may receive an emission control signal line drive, a scanning signal line drive, and other components. The width of the frame is to be minimized.

CITATION LIST

Patent Literature

Patent Literature 1: Japanese Unexamined Patent Application Publication No. 2008-65200

BRIEF SUMMARY

A light emitter board according to an aspect of the present disclosure includes a substrate having a mount surface on which a first light emitter and a second light emitter are mountable, and at least one pixel unit located on the mount surface and including a drive circuit, a first drive line, and a second drive line. The first drive line and the second drive line are connected in parallel to the drive circuit. The first drive line is a primary line, and the second drive line is a redundant line. The light emitter board also includes, on the mount surface, a first positive electrode pad and a first negative electrode pad connectable to the first light emitter, and a second positive electrode pad and a second negative electrode pad connectable to the second light emitter. One of the first positive electrode pad or the first negative electrode pad is connected to the first drive line, and one of the second positive electrode pad or the second negative electrode pad is connected to the second drive line.

A light emitter board according to another aspect of the present disclosure includes a substrate having a mount surface on which a first light emitter and a second light emitter are mountable, and at least one pixel unit located on the mount surface and including a drive circuit, a first drive line, and a second drive line. The first drive line and the second drive line are connected in parallel to the drive circuit. The first drive line is a primary line to primarily drive the first light emitter, and the second drive line is a redundant line to redundantly drive the second light emitter. The light emitter board also includes a switch unit that places one of the first drive line or the second drive line in a conductive state and another of the first drive line or the second drive line in a nonconductive state, and a switch controller that controls the switch unit.

A display device according to another aspect of the present disclosure is a display device including the light emitter board according to one of the above aspects of the present disclosure. The substrate has an opposite surface opposite to the mount surface, and a side surface. The light emitter board includes side wiring on the side surface and a driver on the opposite surface. The first light emitter and the second light emitter are connected to the driver with the side wiring.

A method for repairing a display device according to another aspect of the present disclosure is a method for repairing the display device according to the above aspect. The method includes driving primarily the first light emitter mounted on the mount surface of the substrate, and mounting, upon detection of an abnormal current or an abnormal emission in the first light emitter, the second light emitter on the mount surface and deactivating the first drive line and activating the second drive line.

BRIEF DESCRIPTION OF DRAWINGS

The objects, features, and advantages of the present invention will become apparent from the following detailed description and the drawings.

DETAILED DESCRIPTION

The objects, features, and advantages of the present invention will become apparent from the following detailed description and the drawings.

Figure 9:
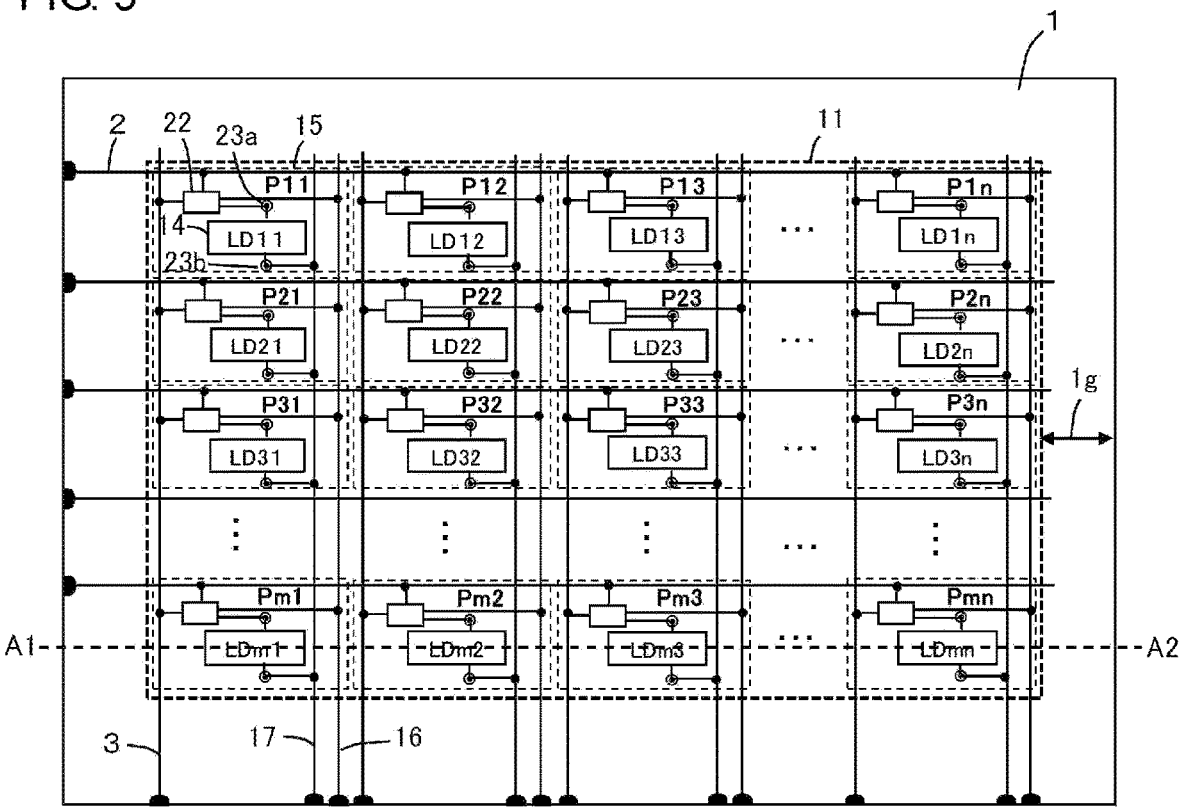
FIG. 9 is a block circuit diagram of an example known display device with a basic structure.
Figure 10A:
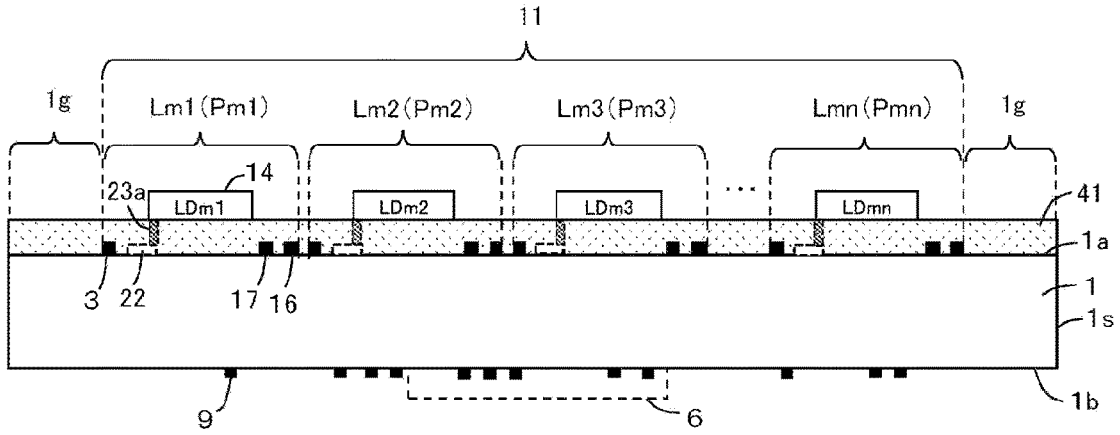
FIG. 10A is a cross-sectional view taken along line A1-A2 in FIG. 9.
Figure 10B:
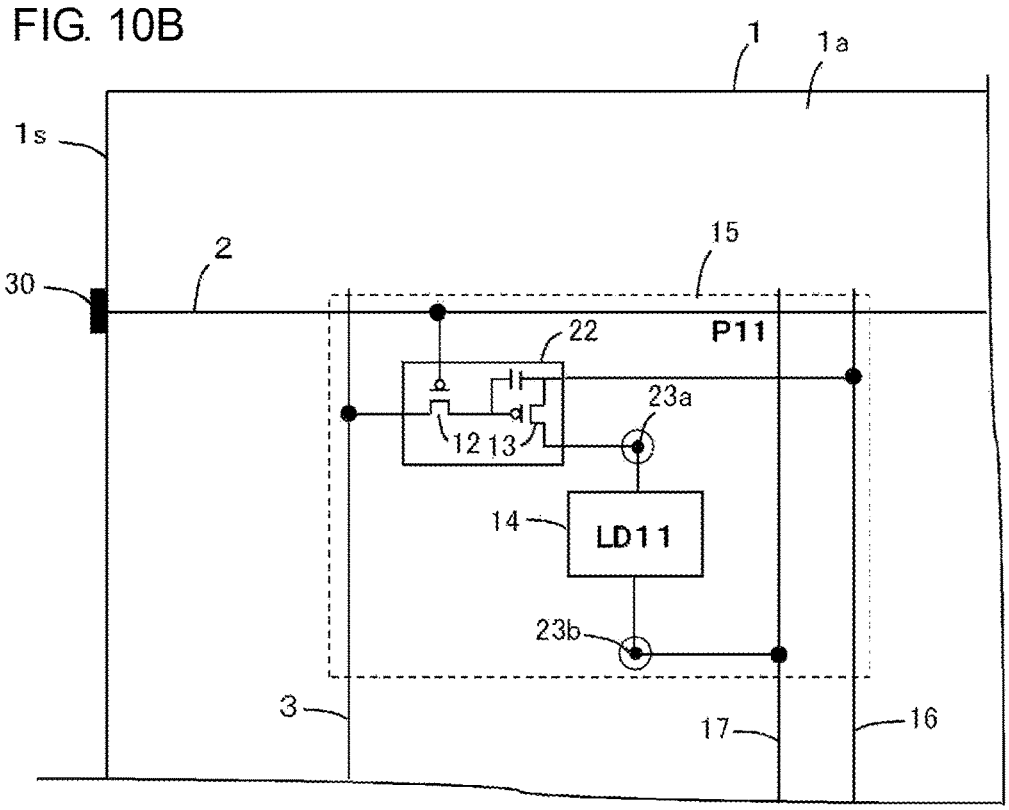
FIG. 10B is an enlarged plan view of one pixel unit in FIG. 9.

The basic structure of a display device according to one or more embodiments of the present disclosure will first be described with reference to FIGS. 9 to 11B. The display device according to one or more embodiments of the present disclosure with the basic structure is a backlight-free, self-luminous display device that includes a light emitter board including light emitters such as micro-light-emitting diodes (LEDs). FIG. 9 is a block circuit diagram of such a display device with the basic structure. FIG. 10A is a cross-sectional view taken along line A1-A2 in FIG. 9.

The display device according to one or more embodiments of the present disclosure with the basic structure includes a glass substrate 1, scanning signal lines 2 extending in a predetermined direction (e.g., a row direction) on the glass substrate 1, emission control signal lines 3 crossing the scanning signal lines 2 and extending in a direction (e.g., a column direction) crossing the predetermined direction, an effective area (pixel area) 11 including multiple pixel units (Pmn) 15 defined by the scanning signal lines 2 and the emission control signal lines 3, and multiple light emitters 14 located on an insulating layer.

The scanning signal lines 2 and the emission control signal lines 3 are connected to back wiring 9 on the back surface of the glass substrate 1 with side wiring 30 (shown in FIG. 10B) on a side surface 1S (shown in FIGS. 10A and 10B) of the glass substrate 1. The back wiring 9 is connected to driving elements 6 such as integrated circuits (ICs) and large-scale integration (LSI) circuits mounted on the back surface of the glass substrate 1. In other words, the display in the display device is driven and controlled by the driving elements 6 on the back surface of the glass substrate 1. The driving elements 6 are mounted on the back surface of the glass substrate 1 by, for example, chip on glass (COG).

Each pixel unit (Pmn) 15 includes an emission controller 22 to control, for example, the emission or non-emission state and the light intensity of the light emitter (LDmn) 14 in an emissive area (Lmn). The emission controller 22 includes a thin-film transistor (TFT) 12 (shown in FIG. 10B) as a switch for inputting a drive signal into the light emitter 14 and a TFT 13 (shown in FIG. 10B) as a driving element for driving the light emitter 14 with a current using an electric potential difference (drive signal) between a positive voltage (anode voltage of about 3 to 5 V) and a negative voltage (a cathode voltage of about −3 to 0 V) corresponding to the level (voltage) of an emission control signal (a signal transmitted through the emission control signal lines 3). The connection line connecting the gate electrode and the source electrode of the TFT 13 receives a capacitor, which retains the voltage of the emission control signal input into the gate electrode of the TFT 13 until the subsequent rewriting is performed (for a period of one frame).

The light emitter 14 is electrically connected to the emission controller 22, a positive voltage input line 16, and a negative voltage input line 17 with feedthrough conductors 23*a* and 23*b* such as through-holes formed through an insulating layer 41 (shown in FIG. 10A) located in the effective area 11. In other words, the positive electrode of the light emitter 14 is connected to the positive voltage input line 16 with the feedthrough conductor 23*a* and the emission controller 22, and the negative electrode of the light emitter 14 is connected to the negative voltage input line 17 with the feedthrough conductor 23*b*.

The display device also includes a frame 1*g* between the effective area 11 and the edge of the glass substrate 1 as viewed in plan. The frame 1*g*, which does not contribute to display, may receive an emission control signal line drive, a scanning signal line drive, and other components. The width of the frame 1*g* is to be minimized.

Figure 11A:
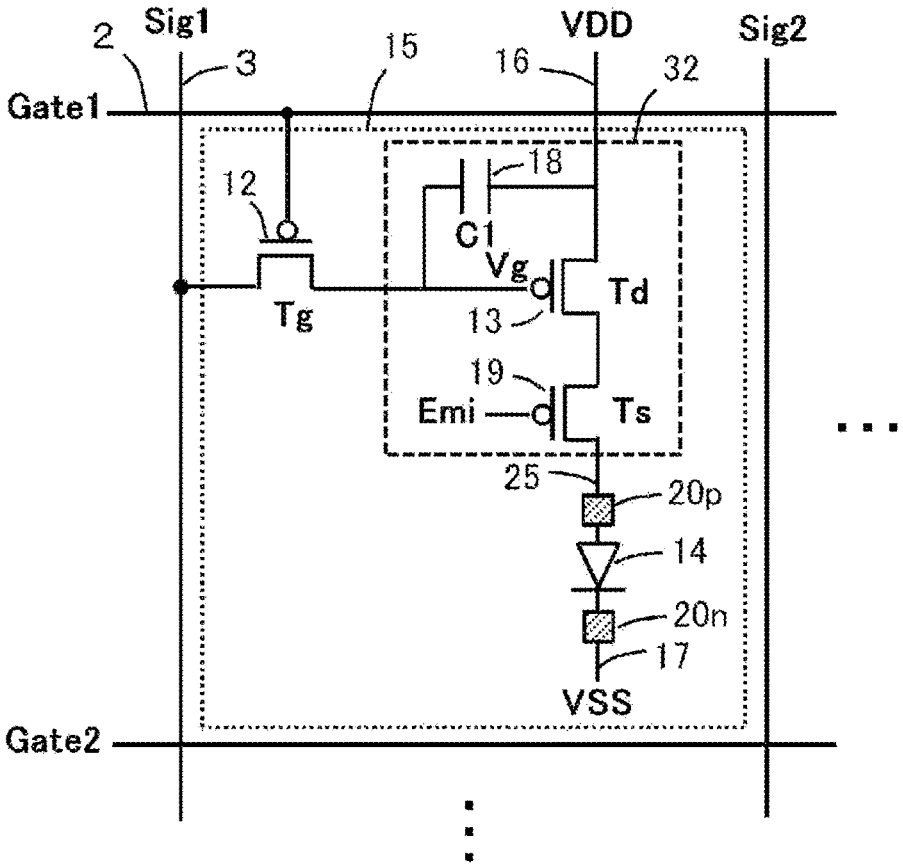
FIG. 11A is a circuit diagram of a pixel unit including a single light emitter included in a known display device.
Figure 11B:
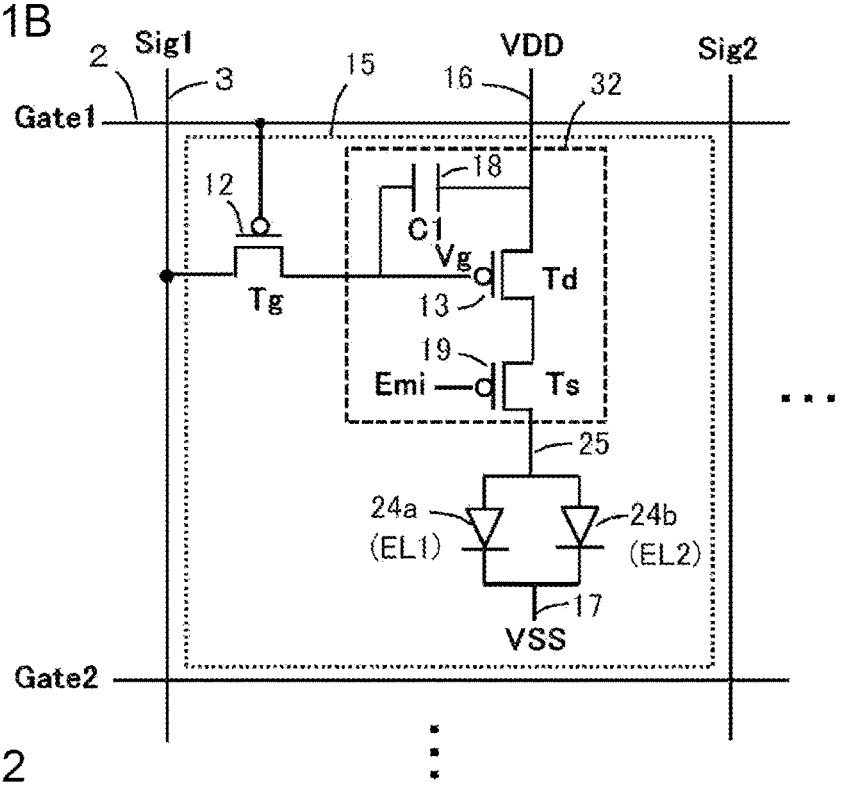
FIG. 11B is a circuit diagram of a pixel unit including a redundant light emitter included in a known display device.

FIGS. 11A and 11B each are a circuit diagram of a pixel unit 15 including a drive circuit 32 as an emission controller in a known light emitter board. The pixel unit 15 includes a p-channel TFT (Tg) 12 as a switch upstream from the drive circuit 32. In response to an on-signal (a low-level signal of −3 to 0 V) transmitted through a scanning signal line (Gate1) 2 input into the gate electrode of the p-channel TFT 12, the TFT 12 has its channel becoming conductive to enter an on-state. This allows an emission control signal (low-level signal, Vg) transmitted through the emission control signal line (Sig1) 3 to be input into the drive circuit 32.

In response to the emission control signal (low-level signal, Vg) input into the gate electrode of a p-channel TFT (Td) 13 as a driving element in the drive circuit 32, the p-channel TFT 13 has its channel becoming conductive to enter an on-state, allowing the drive signal (VDD of about 3 to 5 V) to be input, through the drive line 25, into the light emitter 14, which then emits light. The light intensity (luminance) of the light emitter 14 is controllable by the level (voltage) of the emission control signal (Vg).

In FIG. 11A, the connection line connecting the gate electrode and the source electrode of the p-channel TFT 13 receives a capacitor (C1) 18 that retains capacitance. The drive line 25 connecting the p-channel TFT 13 and the light emitter 14 receives a p-channel TFT (Ts) 19, which controls the emission or non-emission state of the light emitter 14. In response to an emission or non-emission control signal (low-level signal, Emi) input into the gate electrode of the p-channel TFT (Ts) 19, the p-channel TFT 19 has its channel becoming conductive to enter an on-state, allowing the drive signal (VDD) to be input, through the drive line 25, into the light emitter 14, which then emits light. The light emitter 14 is connected to a positive electrode pad 20*p* and a negative electrode pad 20*n* located on the drive line 25 with a conductive connector, such as solder and a thick-film conductive layer.

FIG. 11B is a circuit diagram of a pixel unit 15 in another known example. The light emitter is a two-terminal thin-film element or an organic electroluminescence (EL) element including a pair of electrodes that serve as an anode and a cathode and an emissive layer held between the electrodes. At least one of the electrodes is divided into multiple pieces to divide the light emitter into multiple sub-light emitters (EL1, EL2) 24*a* and 24*b*. The sub-light emitters 24*a* and 24*b* receive a drive current from a driving element 13 and together emit light at a luminance level corresponding to a video signal. When, for example, the sub-light emitter 24*a* has a defect or a short circuit, the sub-light emitter 24*a* is disconnected from the pixel unit 15. The other sub-light emitter 24*b* then receives the drive current. The active matrix display device thus maintains, with the sub-light emitter 24*b*, the emission of light at a luminance level corresponding to a video signal.

In the light emitter board with the structure shown in FIG. 11A including many (about several hundred to several million) light emitters conductively connected to positive electrode pads 20*p* and negative electrode pads 20*n* with, for example, solder, some light emitters may have connection faults and may emit light at a lower, unintended light intensity due to insufficient input of drive signals or may fail to emit light (or may remain off) due to no input of drive signals. The same issue can also arise when the many light emitters include light emitters produced with defects or the emissive layers in some light emitters degrade or break during use and the light emitters become defective.

This issue may be removed by the redundant structure shown in FIG. 11B. In the structure, the light emitter is a thin-film element (EL element) including a stack of thin films located on the board, and at least one of the pair of electrodes is divided into multiple pieces to divide the light emitter into multiple sub-light emitters 24*a* and 24*b*. When the sub-light emitter 24*a* has a defect or a short circuit, the sub-light emitter 24*a* is disconnected from the pixel unit 15. The other sub-light emitter 24*b* then receives the drive current to maintain the light emission at a luminance level corresponding to a video signal. The video signal transmitted first is thus input into the single sub-light emitter 24*b*. In this case, the video signal for the two sub-light emitters 24*a* and 24*b* may be input into the single sub-light emitter 24*b*. This causes overcurrent to flow into the sub-light emitter 24*b*, possibly degrading the sub-light emitter 24*b* over time and shortening its service life. To avoid this, the voltage of the video signal may be lowered before being input into the single sub-light emitter 24*b*. In this case, the light intensity of the sub-light emitter 24*b* can decrease and become insufficient.

A light emitter board, a display device, and a method for repairing the display device according to one or more embodiments of the present disclosure will now be described with reference to the drawings. Each figure referred to below shows main components and other elements of the light emitter board, the display device, and the method for repairing the display device according to one or more embodiments. The light emitter board, the display device, and the method for repairing the display device according to the embodiments may thus include known components not shown in the figures, such as circuit boards, wiring, control ICs, LSI circuits, and housings. In the figures showing the structures in the embodiments, the same components as in FIGS. 8 to 11B showing known example structures are given the same reference numerals and will not be described in detail.

Figure 1:
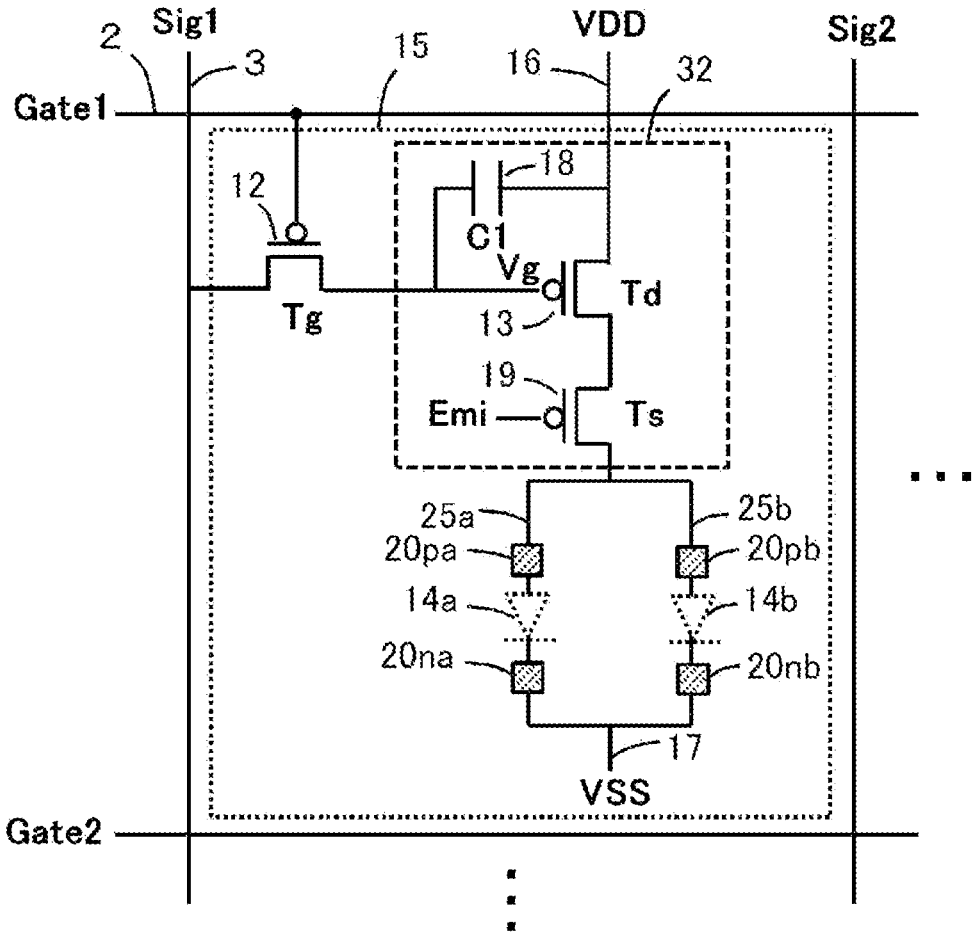
FIG. 1 is a circuit diagram of a pixel unit included in a light emitter board according to an embodiment of the present disclosure.

FIGS. 1 to 7B show the light emitter board according to one or more embodiments. As shown in FIG. 1, the light emitter board includes a substrate 1 having a mount surface 1*a* (shown in FIGS. 10A and 10B) on which a first light emitter 14*a* and a second light emitter 14*b* are mountable, and at least one pixel unit 15 located on the mount surface 1*a* and including a drive circuit 32, a first drive line 25*a*, and a second drive line 25*b*. The first drive line 25*a* and the second drive line 25*b* are connected in parallel to the drive circuit 32. The first drive line 25*a* is a primary line, and the second drive line 25*b* is a redundant line. The pixel unit 15 also includes, on the mount surface 1*a*, a first positive electrode pad 20*pa* and a first negative electrode pad 20*na* connectable to the first light emitter 14*a*, and a second positive electrode pad 20*pb* and a second negative electrode pad 20*nb* connectable to the second light emitter 14*b*. One of the first positive electrode pad 20*pa* or the first negative electrode pad 20*na* is connected to the first drive line 25*a*, and one of the second positive electrode pad 20*pb* or the second negative electrode pad 20*nb* is connected to the second drive line 25*b*.

In FIG. 1, the first positive electrode pad 20*pa* is connected to the first drive line 25*a*, and the first negative electrode pad 20*na* is connected to the ground potential terminal (VSS). When the power terminal (VDD) has a negative potential, the electrode pads may be connected oppositely from this. Similarly, the second positive electrode pad 20*pb* is connected to the second drive line 25*b*, and the second negative electrode pad 20*nb* is connected to the ground potential terminal (VSS). When the power terminal (VDD) has a negative potential, the electrode pads may be connected oppositely from this.

The above structure provides the effects described below. The first light emitter 14*a* conductively connected to the first positive electrode pad 20*pa* and the first negative electrode pad 20*na* with, for example, solder may have connection faults, or the first light emitter 14*a* may be a defective product. In this case, the first drive line 25*a* may be deactivated (placed in an unused state), and the second light emitter 14*b* may be connected to the second positive electrode pad 20*pb* and the second negative electrode pad 20*nb* to activate the second drive line 25*b* (place in a used state). This effectively reduces the pixel units 15 having emission faults or emission failures. The first positive electrode pad 20*pa* and the second positive electrode pad 20*pb* are physically and electrically independent of each other, and the first negative electrode pad 20*na* and the second negative electrode pad nb are physically and electrically independent of each other. Such drive systems independent of each other eliminate any further adjustment to the drive signal after the primarily driven light emitter is switched from the first light emitter 14*a* to the second light emitter 14*b*. This prevents the drive signal line drive (emission control signal line drive) from becoming complicated and thus from increasing power consumption. The structure can avoid overcurrent flowing into the second light emitter 14*b* as in the known structure, and thus can avoid a shorter service life of the second light emitter 14*b*.

In FIG. 1, one pixel unit 15 includes one first drive line 25*a* as the primary line and one second drive line 25*b* as the redundant line. In some embodiments, one pixel unit 15 may include multiple redundant lines. In this case, the increased redundancy reduces the likelihood that the pixel units 15 have display faults. In some embodiments, one pixel unit 15 may include multiple primary lines. In this case, the display device or other devices can display multiple colors or enable color display.

In some embodiments, the light emitter board with the structure in FIG. 1 may eliminate the first light emitter 14*a* and the second light emitter 14*b*. In some embodiments, the first light emitter 14*a* alone may be mounted and primarily driven on the light emitter board, and the second light emitter 14*b* may be mounted on the light emitter board when any abnormality such as a decrease in light intensity occurs in the first light emitter 14*a*. In some embodiments, the first light emitter 14*a* and the second light emitter 14*b* may be premounted on the light emitter board.

The substrate 1 included in the light emitter board according to the present embodiment may be a translucent substrate such as a glass substrate and a plastic substrate, or a non-translucent substrate such as a ceramic substrate, a non-translucent plastic substrate, and a metal substrate. The substrate 1 may further be a composite substrate including a laminate of a glass substrate and a plastic substrate, a laminate of a glass substrate and a ceramic substrate, a laminate of a glass substrate and a metal substrate, or a laminate of at least any two of the above substrates formed from different materials. The substrate 1 including an electrically insulating substrate, such as a glass substrate, a plastic substrate, or a ceramic substrate, allows easy formation of wiring conductors. The substrate 1 may be rectangular, circular, oval, trapezoidal, or in any other shape.

The light emitters used in the light emitter board according to the present embodiment are self-luminous and free of backlight. Examples include micro-LEDs, semiconductor laser elements, inorganic EL elements, and organic EL elements. The light emitters are in chips mountable on the substrate 1. The micro-LEDs have high emission efficiency with low power consumption and have a long service life. The micro-LEDs are also small and easily connectable to electrode pads. The light emitter board according to the present embodiment can be used in a display device that performs high-quality image display and allows easy repair of the light emitters. The micro-LEDs are mounted vertically on (perpendicularly to) the mount surface Ta of the substrate 1. The mounted micro-LEDs include, for example, a positive electrode, an emissive layer, and a negative electrode stacked in this order from near the mount surface Ta. In some embodiments, the micro-LED may include a negative electrode, an emissive layer, and a positive electrode stacked in this order from near the mount surface Ta.

Each micro-LED rectangular as viewed in plan may have, but is not limited to, a size of at least about 1 μm and not more than 100 μm on each side, or more specifically of at least about 3 μm and not more than 10 μm on each side.

The micro-LED in each pixel unit 15 may emit light of a different color. For example, a micro-LED located in a first pixel unit may emit red, orange, red-orange, red-violet, or violet light. A micro-LED located in a second pixel unit adjacent to the first pixel unit may emit green or yellow-green light. A micro-LED located in a third pixel unit adjacent to the second pixel unit may emit blue light. Such a light emitter board allows easy fabrication of a color display device. In some embodiments, one pixel unit 15 may include two or more primarily driven micro-LEDs.

The first positive electrode pad 20*pa*, the first negative electrode pad 20*na*, the second positive electrode pad 20*pb*, and the second negative electrode pad 20*nb* are conductor layers including, for example, tantalum (Ta), tungsten (W), titanium (Ti), molybdenum (Mo), aluminum (Al), chromium (Cr), silver (Ag), or copper (Cu). The first positive electrode pad 20*pa*, the first negative electrode pad 20*na*, the second positive electrode pad 20*pb*, and the second negative electrode pad 20*nb* may be metal layers including Mo/Al/Mo layers (indicating a stack of a Mo layer, an Al layer, and a Mo layer in this order) or metal layer(s) including an Al layer, Al/Ti layers, Ti/Al/Ti layers, a Mo layer, Mo/Al/Mo layers, Ti/Al/Mo layers, Mo/Al/Ti layers, a Cu layer, a Cr layer, a Ni layer, or a Ag layer. The positive and negative electrodes of each light emitter may also have the same structure as the first positive electrode pad 20*pa*, the first negative electrode pad 20*na*, the second positive electrode pad 20*pb*, and the second negative electrode pad 20*nb*.

The pixel unit 15 functions as a basic element of display. For a monochromatic image display device, for example, the light intensity (luminance) of each of many first light emitters 14*a* is controlled to enable display of monochromatic images. A color display device may include many sets of color display units each including a subpixel unit with a red-light emissive first light emitter 14*a*, a subpixel unit with a green-light emissive first light emitter 14*a*, and a subpixel unit with a blue-light emissive first light emitter 14*a* to enable display of color tones.

In each pixel unit 15, the drive circuit (emission controller) 32 including a TFT, serving as a switch or a control element for controlling the emission or non-emission state and the light intensity of the light emitter, may be located below the light emitter with an insulating layer between them. This structure downsizes the pixel unit 15 and enables high-quality image display with the display device including the light emitter board according to the present embodiment.

The light emitter board according to the present embodiment may have either the second positive electrode pad 20*pb* with a greater area than the first positive electrode pad 20*pa* as viewed in plan or the second negative electrode pad 20*nb* with a greater area than the first negative electrode pad 20*na* as viewed in plan, or both such second positive electrode pad 20*pb* and second negative electrode pad 20*nb*. This structure improves the connection of the redundant second light emitter 14*b* to the second positive electrode pad 20*pb* and the second negative electrode pad 20*nb*. The second light emitter 14*b* is more easily connected to the second positive electrode pad 20*pb* with a larger area or to the second negative electrode pad 20*nb* with a larger area, and is thus less likely to have a connection fault. Additionally, when the second light emitter 14*b* is positioned by optically sensing the second positive electrode pad 20*pb* and the second negative electrode pad 20*nb* with an imaging device such as a camera, the second positive electrode pad 20*pb* and the second negative electrode pad 20*nb* are easily optically sensible.

For example, the light emitter board may have either the second positive electrode pad 20*pb* rectangular and larger than the first positive electrode pad 20*pa* that is square as viewed in plan or the second negative electrode pad 20*nb* rectangular and larger than the first negative electrode pad 20*na* that is square as viewed in plan, or both such second positive electrode pad 20*pb* and second negative electrode pad 20*nb*.

To improve the conductive connection of the second positive electrode pad 20*pb* and the second negative electrode pad 20*nb* to the second light emitter 14*b* with a conductive connector such as solder, the second positive electrode pad 20*pb* and the second negative electrode pad 20*nb* may have rough surfaces. The roughness allows the conductive connector to be anchored to the rough surfaces with higher bonding strength. The rough surfaces may have an arithmetic mean roughness of about 1 to 100 μm. The surfaces of the second positive electrode pad 20*pb* and the second negative electrode pad 20*nb* may be roughened by, for example, etching or dry etching or controlling the film deposition time and temperature in forming the second positive electrode pad 20*pb* and the second negative electrode pad 20*nb* with a thin film formation method, such as chemical vapor deposition (CVD). Grain structures such as giant single crystal grains and giant polycrystal grains form in the thin film.

The light emitter board according to the present embodiment may have either the second positive electrode pad 20*pb* with a higher light reflectance than the first positive electrode pad 20*pa* or the second negative electrode pad 20*nb* with a higher light reflectance than the first negative electrode pad 20*na*, or both such second positive electrode pad 20*pb* and second negative electrode pad 20*nb*. This structure improves the connection of the redundant second light emitter 14*b* to the second positive electrode pad 20*pb* and the second negative electrode pad 20*nb*. In other words, the second light emitter 14*b* is more easily connectable to the second positive electrode pad 20*pb* with a higher light reflectance and the second negative electrode pad 20*nb* with a higher light reflectance. For example, when the second light emitter 14*b* is positioned by optically sensing the second positive electrode pad 20*pb* and the second negative electrode pad 20*nb* with an imaging device such as a camera, the second positive electrode pad 20*pb* and the second negative electrode pad 20*nb* are easily optically sensible.

Figure 2:
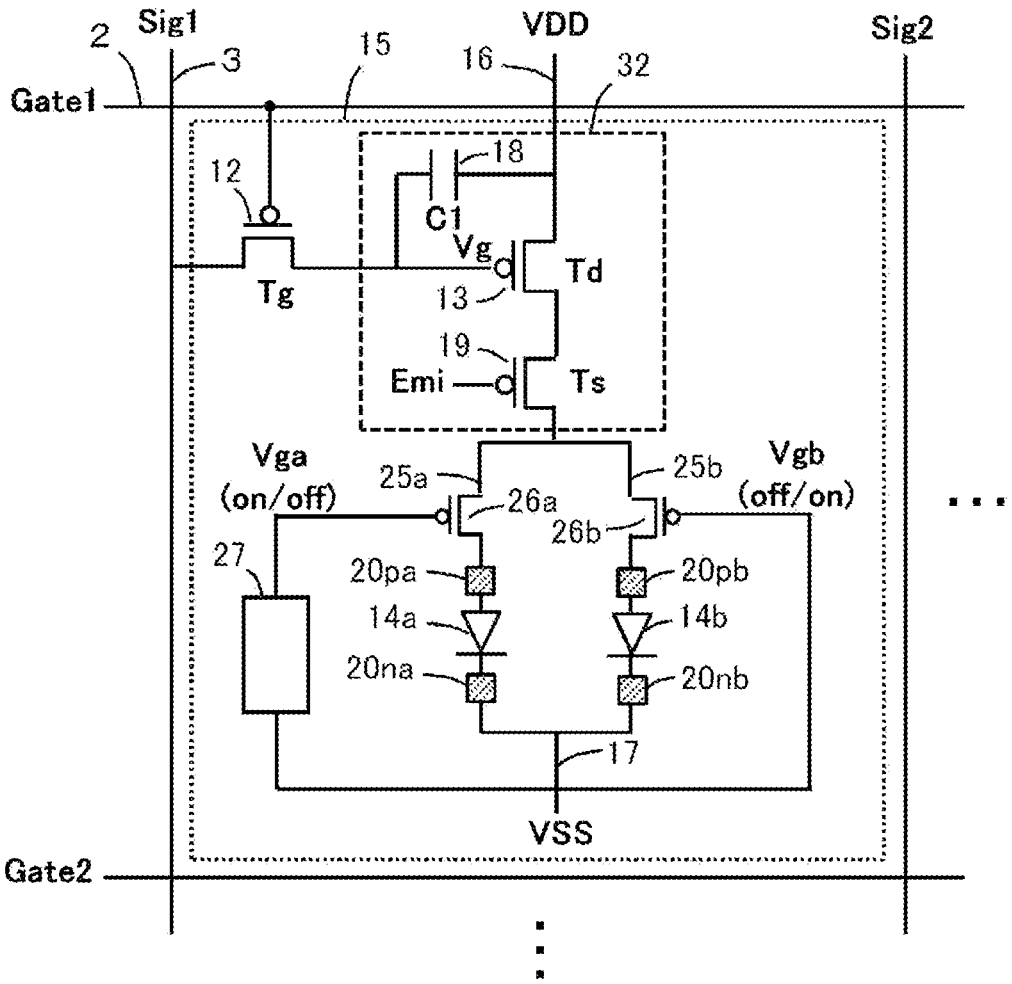
FIG. 2 is a circuit diagram of a pixel unit included in a light emitter board according to another embodiment of the present disclosure.

As shown in FIG. 2, the light emitter board according to one or more embodiments may include a first switch 26*a* on the first drive line 25*a* to activate and deactivate the first drive line 25*a*, and a second switch 26*b* on the second drive line 25*b* to activate and deactivate the second drive line 25*b*. This structure facilitates switching between a drive mode in which the first drive line 25*a* is activated and the second drive line 25*b* is deactivated and a drive mode in which the first drive line 25*a* is deactivated and the second drive line 25*b* is activated.

The light emitter board may include a switch controller 27 that controls one of the first switch 26*a* or the second switch 26*b* to be closed and the other of the first switch 26*a* or the second switch 26*b* to be open. This structure allows prompt switching of the primarily driven light emitter from the first light emitter 14*a* to the second light emitter 14*b*, thus removing emission faults immediately.

In a first drive mode in which the first light emitter 14*a* is primarily driven, the switch controller 27 inputs an on-signal (low-level signal, Vga) into the gate electrode of the first switch 26*a* including a p-channel TFT to activate the primary first drive line 25*a* and inputs an off-signal (high-level signal, Vgb) into the gate electrode of the second switch 26*b* including a p-channel TFT to deactivate the redundant second drive line 25*b*. In a second drive mode in which the second light emitter 14*b* is primarily driven, the switch controller 27 inputs an off-signal (high-level signal, Vga) into the gate electrode of the first switch 26*a* including the p-channel TFT to deactivate the primary first drive line 25*a* and inputs an on-signal (low-level signal, Vgb) into the gate electrode of the second switch 26*b* including the p-channel TFT to activate the redundant second drive line 25*b*.

Figure 3:
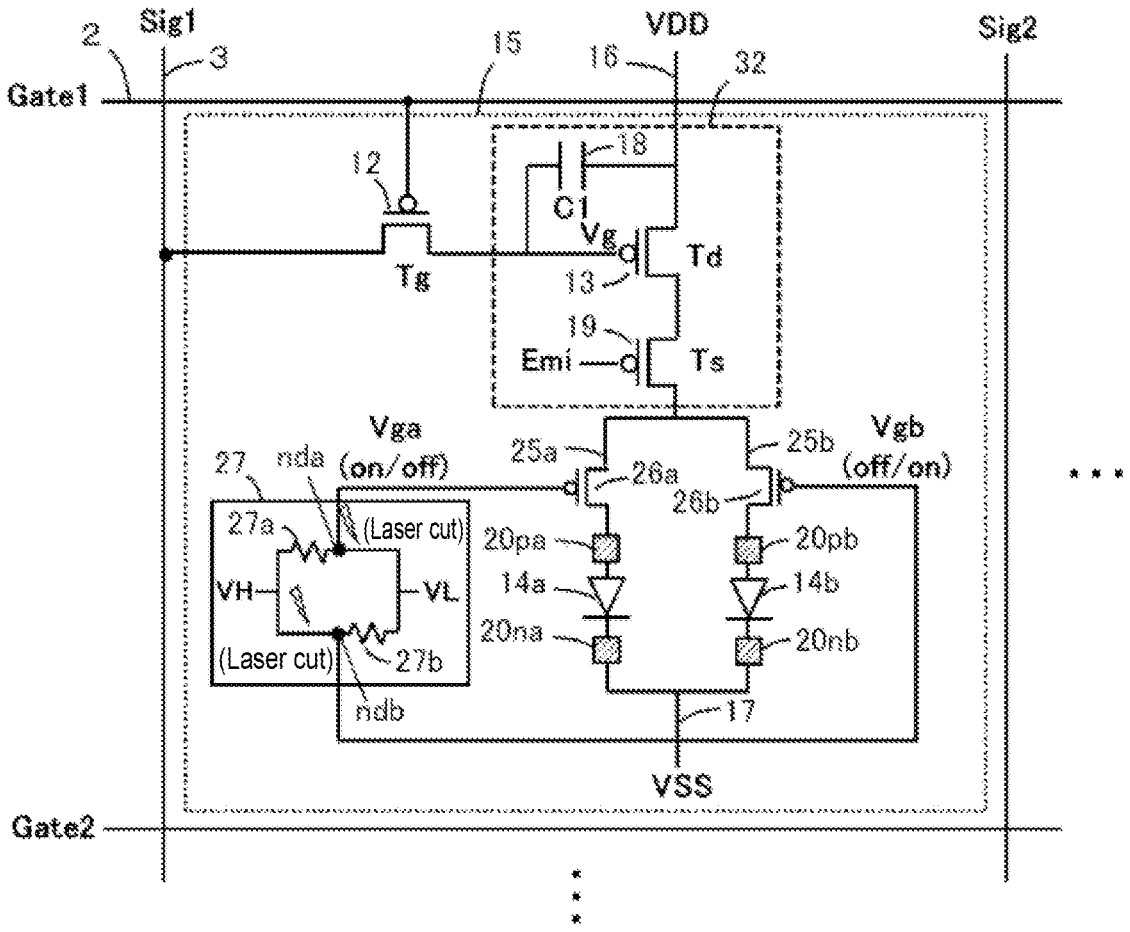
FIG. 3 is a circuit diagram of a pixel unit included in a light emitter board according to another embodiment of the present disclosure.

The switch controller 27 may have the structure shown in FIG. 3. To input an on-signal (low-level signal, Vga) into the gate electrode of the first switch 26*a* in the first drive state, the switch controller 27 blocks transmission of a high-level signal with a resistor 27*a* located on the connection line between a VH signal terminal outputting a high-level signal and the gate electrode of the first switch 26*a* while allowing the connection line between a VL signal terminal outputting a low-level signal and the gate electrode of the first switch 26*a* to be conductive. To input an off-signal (high-level signal, Vgb) into the gate electrode of the second switch 26*b*, the switch controller 27 allows the connection line between the VH signal terminal outputting a high-level signal and the gate electrode of the second switch 26*b* to be conductive while blocking transmission of a low-level signal with a resistor 27*b* located on the connection line between the VL signal terminal outputting a low-level signal and the gate electrode of the second switch 26*b*.

To switch to the second drive mode, the switch controller 27 inputs an off-signal (high-level signal, Vga) into the gate electrode of the first switch 26*a*. This involves melting and cutting, by laser cutting, the connection line connecting the VL signal terminal and the gate electrode of the first switch 26*a* at a portion between the VL signal terminal and a node nda. The switch controller 27 then outputs, from the VH signal terminal, an off-signal (high-level signal, Vga) reflecting the amount of voltage drop across the resistor 27*a*. To input an on-signal (low-level signal, Vgb) into the gate electrode of the second switch 26*b*, the connection line connecting the VH signal terminal and the gate electrode of the second switch 26*b* is melted and cut by laser cutting at a portion between the VH signal terminal and a node ndb. The switch controller 27 then outputs, from the VL signal terminal, an on-signal (low-level signal, Vgb) reflecting the amount of voltage drop across the resistor 27*b*. The laser cutting may be replaced by mechanical cutting using, for example, a grinder or by chemical cutting using, for example, etching.

Figure 4A:
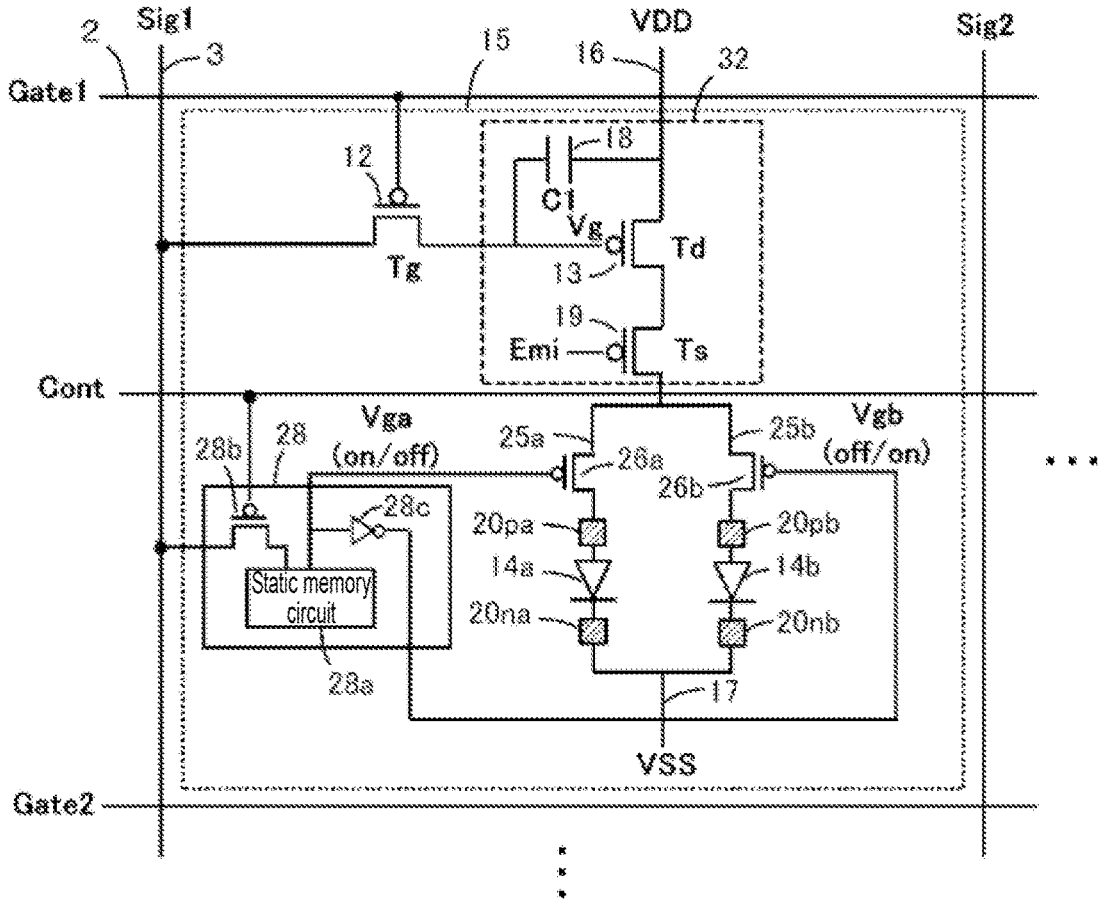
FIG. 4A is a circuit diagram of a pixel unit included in a light emitter board according to another embodiment of the present disclosure.
Figure 4B:
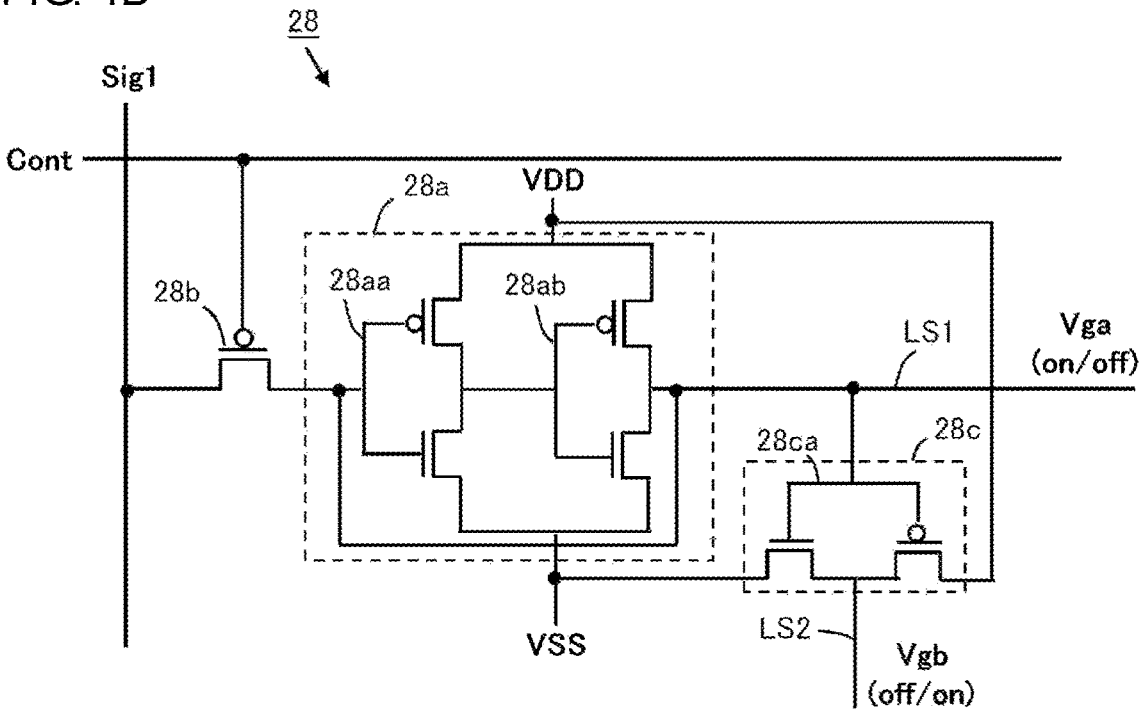
FIG. 4B is a circuit diagram of an example switch controller in the pixel unit in FIG. 4A.

FIGS. 4A and 4B show a light emitter board according to another embodiment of the present disclosure. A switch controller 28 includes a static memory circuit 28*a* connected in parallel to the first switch 26*a* and the second switch 26*b*, and an inverter logic circuit 28*c*. The inverter logic circuit 28*c* may be located either on a first connection line LS1 connecting the static memory circuit 28*a* and the first switch 26*a* or on a second connection line LS2 connecting the static memory circuit 28*a* and the second switch 26*b*. In this example, the static memory circuit 28*a* can retain the receiving high- or low-level signal as an output signal, thus easily maintaining a drive mode in which the first light emitter 14*a* is primarily activated and the second light emitter 14*b* is deactivated. The static memory circuit 28*a* also easily maintains a drive mode in which the light emitters are driven oppositely.

The switch controller 28 includes the static memory circuit 28*a* including a static random-access memory (RAM), a switch 28*b* including a p-channel TFT, and the inverter logic circuit or an inverter 28*c*. The switch 28*b* has the gate electrode connected to a gate control signal line (Cont). In response to an on-signal (low-level signal) transmitted through the gate control signal line, the switch 28*b* has its channel becoming conductive (or entering an on-state). The source electrode of the switch 28*b* is connected to the emission control signal line (Sig1) 3.

To place the first light emitter 14*a* in a primarily activated state and the second light emitter 14*b* in a deactivated state, the switch 28*b* receives an on-signal through its gate electrode to enter an on-state, transmits the on-signal (low-level signal) transmitted through the emission control signal line 3 to the switch 26*a* through the static memory circuit 28*a*, and transmits an off-signal (high-level signal), which is the inverted signal of the on-signal, to the switch 26*b* through the static memory circuit 28*a* and the inverter 28*c*. This places the first light emitter 14*a* in a primarily activated state and the second light emitter 14*b* in a deactivated state. In this state, the static memory circuit 28*a* remains outputting the on-signal to the switch 26*a* and the off-signal to the switch 26*b*.

To place the first light emitter 14*a* in a deactivated state and the second light emitter 14*b* in a primarily activated state, the switch 28*b* receives an on-signal through its gate electrode to enter an on-state, transmits the off-signal (high-level signal) transmitted through the emission control signal line 3 to the switch 26*a* through the static memory circuit 28*a*, and transmits an on-signal (low-level signal), which is the inverted signal of the off-signal, to the switch 26*b* through the static memory circuit 28*a* and the inverter 28*c*. This places the first light emitter 14*a* in a deactivated state and the second light emitter 14*b* in a primarily activated state. In this state, the static memory circuit 28*a* remains outputting the off-signal to the switch 26*a* and the on-signal to the switch 26*b*.

As shown in FIG. 4B, the static memory circuit 28*a* includes a first inverter 28*aa* and a second inverter 28*ab* connected in series. The first inverter 28*aa* includes a p-channel TFT and an n-channel TFT with their gate electrodes connected commonly and their drain electrodes connected commonly. The source electrode of the p-channel TFT is connected to the positive voltage supply (VDD), and the source electrode of the n-channel TFT is connected to the negative voltage supply (VSS). The second inverter 28*ab* has the same structure as the first inverter 28*aa*.

The static memory circuit 28*a* operates in the manner described below. The first inverter 28*aa* receiving an on-signal (off-signal) at the input end (gate electrode) inverts the on-signal into an off-signal (on-signal), which is then output from the output end (drain electrode) to be input into the input end of the second inverter 28*ab*. The second inverter 28*ab* receiving the off-signal (on-signal) at the input end inverts the off-signal into an on-signal (off-signal), which is then output from the output end. The static memory circuit 28*a* remains outputting the signals in this manner until receiving an off-signal newly transmitted from the switch 28*b*. The inverter 28*c* has the same structure as the first inverter 28*aa*.

Figure 5A:
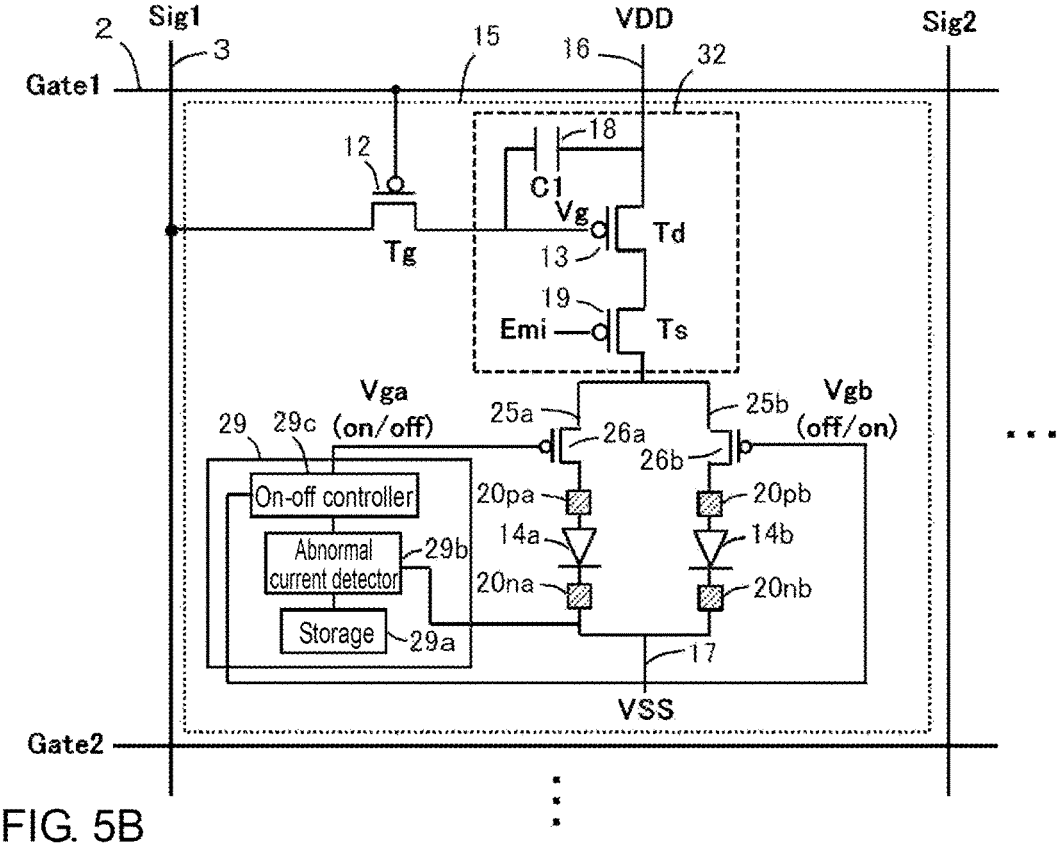
FIG. 5A is a circuit diagram of a pixel unit included in a light emitter board according to another embodiment of the present disclosure.
Figure 5B:
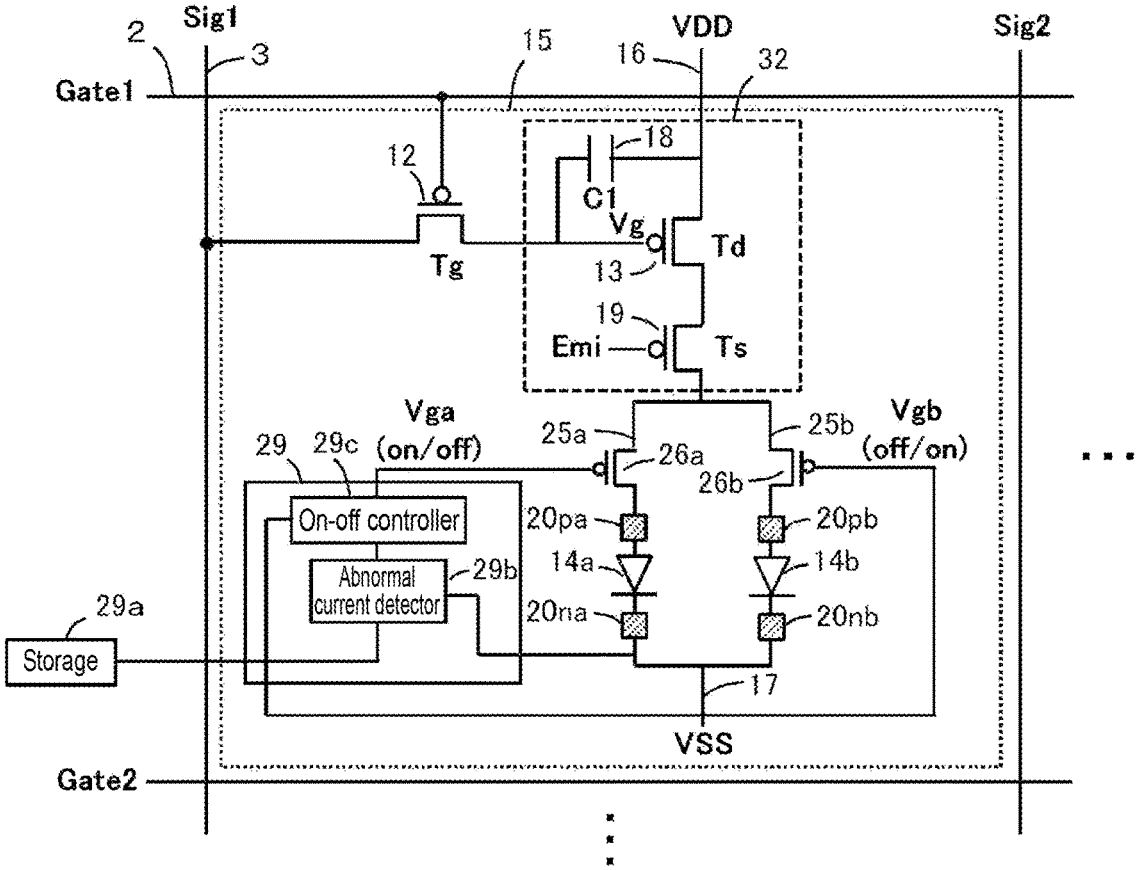
FIG. 5B is a circuit diagram of a pixel unit included in a light emitter board according to another embodiment of the present disclosure.

FIGS. 5A and 5B show more specific examples of the switch controller 27 in the light emitter board shown in FIG. 2. As shown in FIGS. 5A and 5B, a switch controller 29 includes a storage 29*a* that stores voltage-current correlation data for a drive voltage and a drive current of a reference light emitter, and an abnormal current detector 29*b* that detects any abnormality in the current through the first light emitter 14*a* by referencing the voltage-current correlation data. Upon detecting any abnormal current in the first light emitter 14*a*, the switch controller 29 may control the first switch 26*a* to be open and the second switch 26*b* to be closed. This structure allows more automated and accurate detection of emission faults in the first light emitter 14*a* than in the structure in which the emission state of the first light emitter 14*a* is detected visually.

The abnormal current detector 29*b* in the light emitter board shown in FIGS. 5A and 5B may compare a reference drive current corresponding to a reference drive voltage in voltage-current correlation data 50 (shown in FIG. 7A) with a measured drive current of the first light emitter 14*a* at the reference drive voltage, and detect an abnormal current in the first light emitter 14*a* in response to the measured drive current deviating from the reference drive current by a predetermined value or greater. This structure allows more accurate detection of emission faults in the first light emitter 14*a*.

The abnormal current detector 29*b*, which detects an abnormal current in the first drive line 25*a*, measures, as a measured drive current, the drive current transmitted through a detection line connected to the first drive line 25*a*. The abnormal current detector 29*b* compares a measured drive current 52*a* (52*b*) with the reference drive current corresponding to the reference drive voltage in the voltage-current correlation data 50 (shown in FIG. 7A) stored in the storage 29*a*. The measured drive current 52*a* has a value deviating from the reference drive current within an allowable range. The measured drive current 52*b* has a value deviating from the reference drive current beyond the allowable range. For the measured drive current 52*a*, the switch controller 29 does not perform switching control. The first light emitter 14*a* remains in the primarily activated state, and the second light emitter 14*b* remains in the deactivated state. For the measured drive current 52*b*, the switch controller 29 performs switching control with an on-off controller 29*c*. In other words, the first light emitter 14*a* is switched to a deactivated state, and the second light emitter 14*b* is switched to an activated state or to a primarily activated state. The on-off controller 29*c* may include, for example, the switch 28*b*, the static memory circuit 28*a*, and the inverter 28*c* shown in FIGS. 4A and 4B.

Figure 7A:
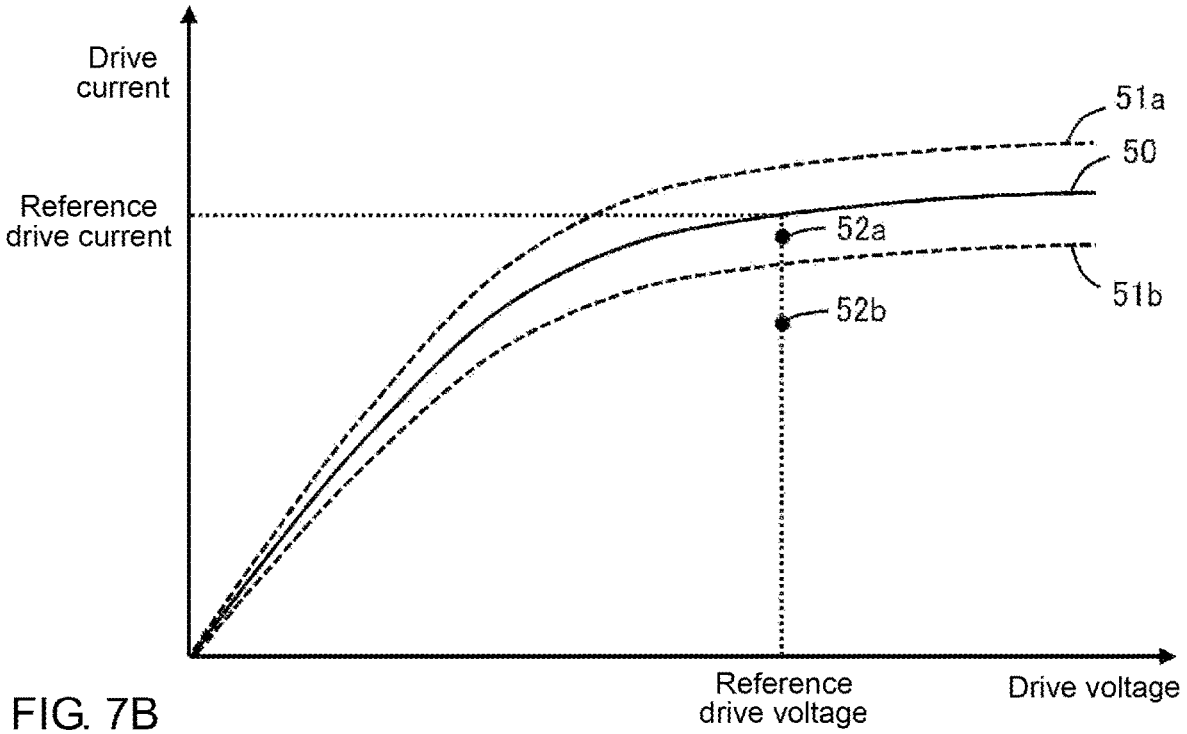
FIG. 7A is a graph showing voltage-current correlation data for detection of an abnormal current in a first light emitter included in a light emitter board according to another embodiment of the present disclosure.

The deviation of the measured drive current within +10% from 100% of the value of the reference drive current is determined to be within the allowable range. In FIG. 7A, the plot 51*a* is voltage-current correlation data for a measured drive current deviating from the reference drive current by +10%, and the plot 51*b* is voltage-current correlation data for a measured drive current deviating from the reference drive current by −10%. The degree of deviation is not limited to the above range, but can be specified variously based on, for example, the allowable range of the intended display quality and degradation of the light emitters over time.

In FIG. 5A, the storage 29*a* is inside the pixel unit 15. In FIG. 5B, the storage 29*a* is outside the pixel unit 15 or at the periphery of the effective area (display area). With, for example, a large memory capacity, the storage 29*a* is located as in the structure in FIG. 5B to avoid an excessively large pixel unit 15.

Figure 6A:
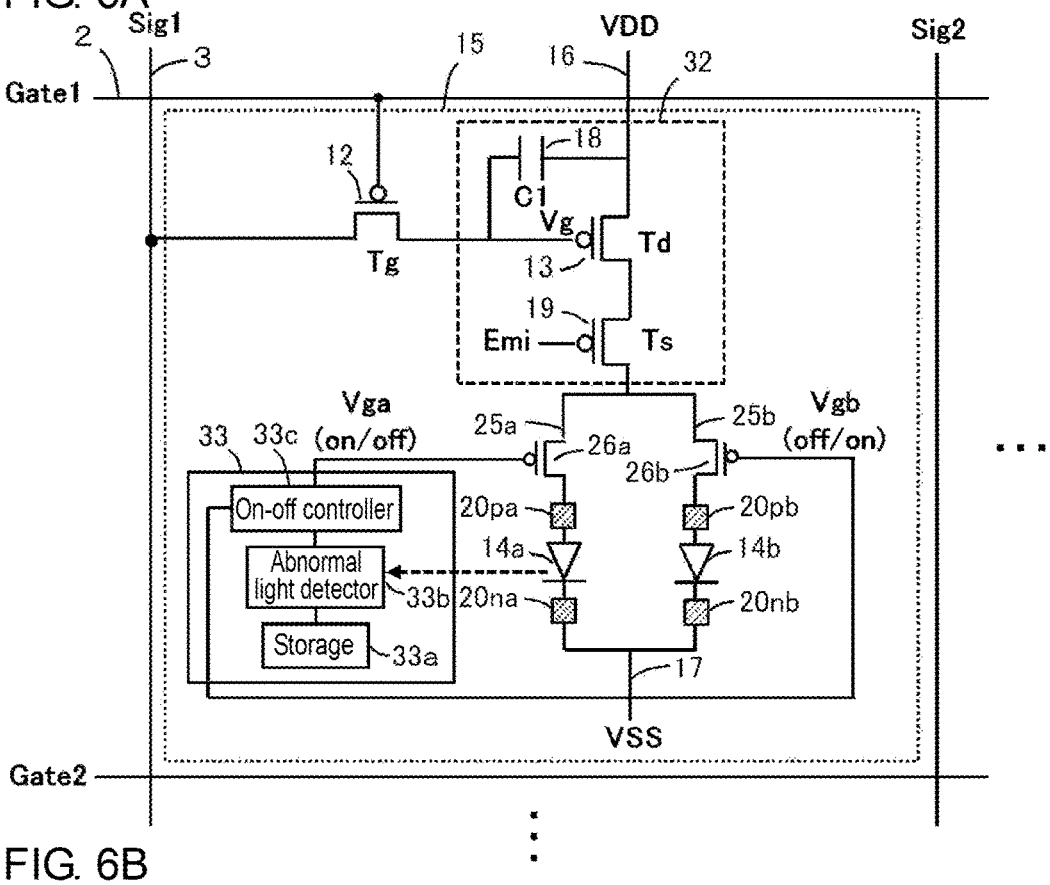
FIG. 6A is a circuit diagram of a pixel unit included in a light emitter board according to another embodiment of the present disclosure.
Figure 6B:
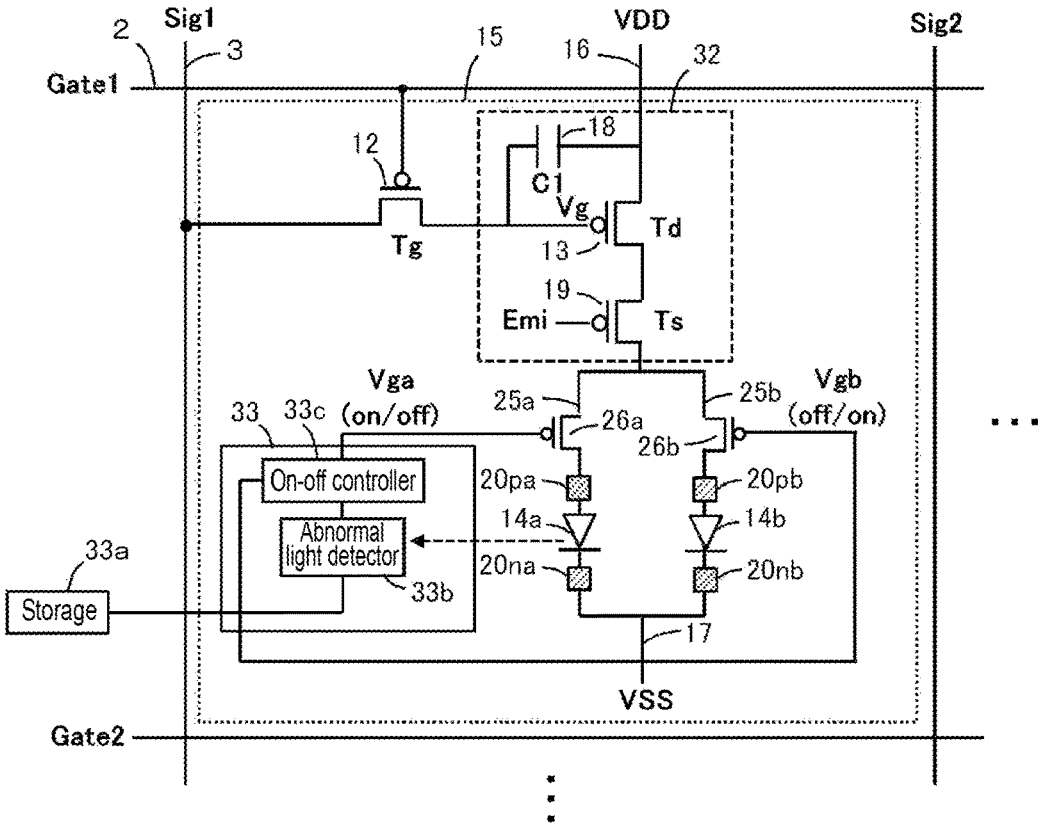
FIG. 6B is a circuit diagram of a pixel unit included in a light emitter board according to another embodiment of the present disclosure.

FIGS. 6A and 6B show other specific examples of the switch controller 27 in the light emitter board shown in FIG. 2. As shown in FIGS. 6A and 6B, a switch controller 33 includes a storage 33*a* that stores voltage-emission correlation data 60 (shown in FIG. 7B) about the drive voltage and the light intensity of a reference light emitter, and an abnormal emission detector 33*b* that detects any abnormality in emission from the first light emitter 14*a* by referencing the voltage-emission correlation data 60. Upon detecting any abnormal emission in the first light emitter 14*a*, the switch controller 33 may control the first switch 26*a* to be open and the second switch 26*b* to be closed. This structure allows more automated and accurate detection of emission faults in the first light emitter 14*a* than in the structure in which the emission state of the first light emitter 14*a* is detected visually.

The abnormal emission detector 33*b* in the light emitter board shown in FIGS. 6A and 6B compares a reference light intensity corresponding to a reference drive voltage in the voltage-emission correlation data 60 with a measured light intensity of the first light emitter 14*a* at the reference drive voltage, and detects an abnormal emission in the first light emitter 14*a* in response to the measured light intensity deviating from the reference light intensity by a predetermined value or greater. This structure allows more accurate detection of emission faults in the first light emitter 14*a*.

The abnormal emission detector 33*b*, which detects an abnormal emission in the first drive line 25*a*, includes a light receiver that performs photoelectric conversion. Examples of the light receiver include a photodiode that detects the light intensity (luminance) of the first light emitter 14*a* connected to the first drive line 25*a* and a TFT that changes its conduction-state as the channel receives light. The abnormal emission detector 33*b* receives light emitted from the first light emitter 14*a* as a measured light intensity. The abnormal emission detector 33*b* compares a measured light intensity 62*a* (62*b*) with the reference light intensity corresponding to the reference drive voltage in the voltage-emission correlation data 60 (shown in FIG. 7B) stored in the storage 33*a*. The measured light intensity 62*a* has a value deviating from the reference light intensity within an allowable range. The measured light intensity 62*b* has a value deviating from the reference light intensity beyond the allowable range. For the measured light intensity 62*a*, the switch controller 33 does not perform switching control. The first light emitter 14*a* remains in the primarily activated state, and the second light emitter 14*b* remains in the deactivated state. For the measured light intensity 62*b*, the switch controller 33 performs the switching control with an on-off controller 33*c*. In other words, the first light emitter 14*a* is switched to a deactivated state, and the second light emitter 14*b* is switched to an activated state or to a primarily activated state. The on-off controller 33*c* may include, for example, the switch 28*b*, the static memory circuit 28*a*, and the inverter 28*c* shown in FIGS. 4A and 4B.

Figure 7B:
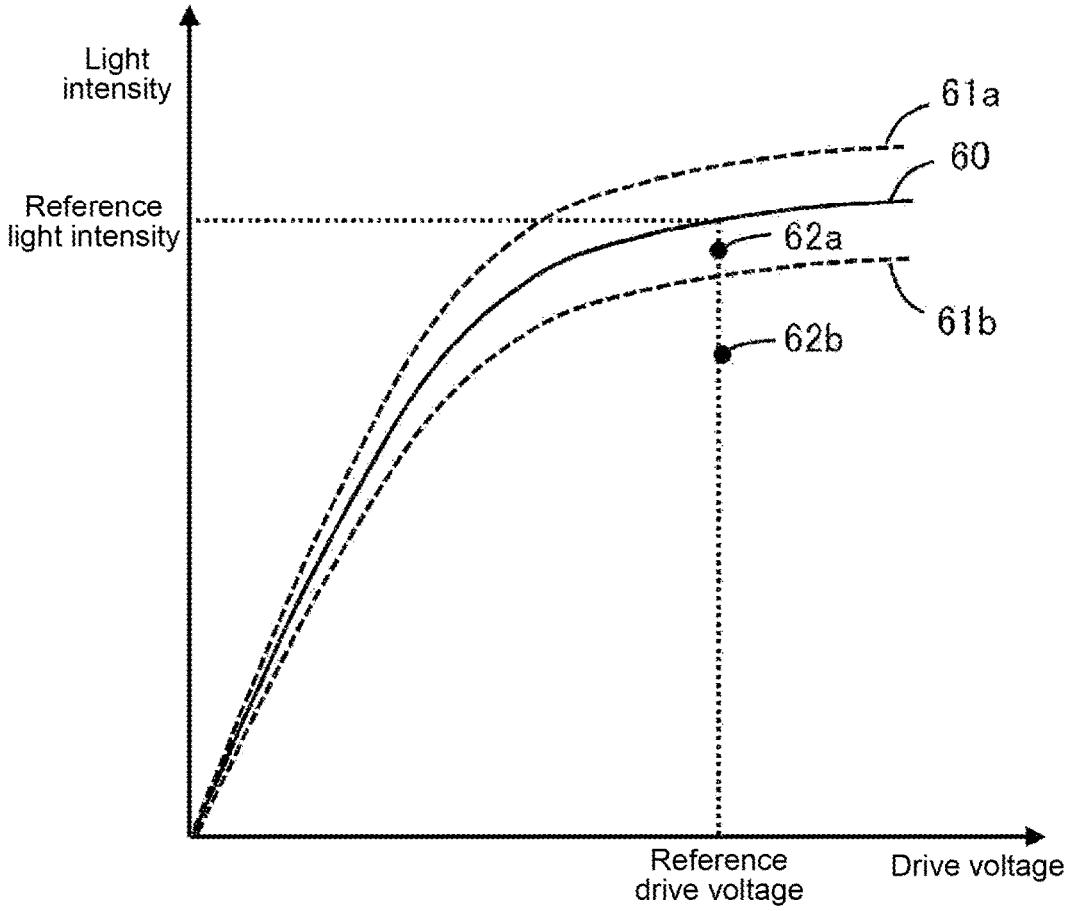
FIG. 7B is a graph showing voltage-emission correlation data for detection of an abnormal emission in a first light emitter included in a light emitter board according to another embodiment of the present disclosure.
Figure 8:
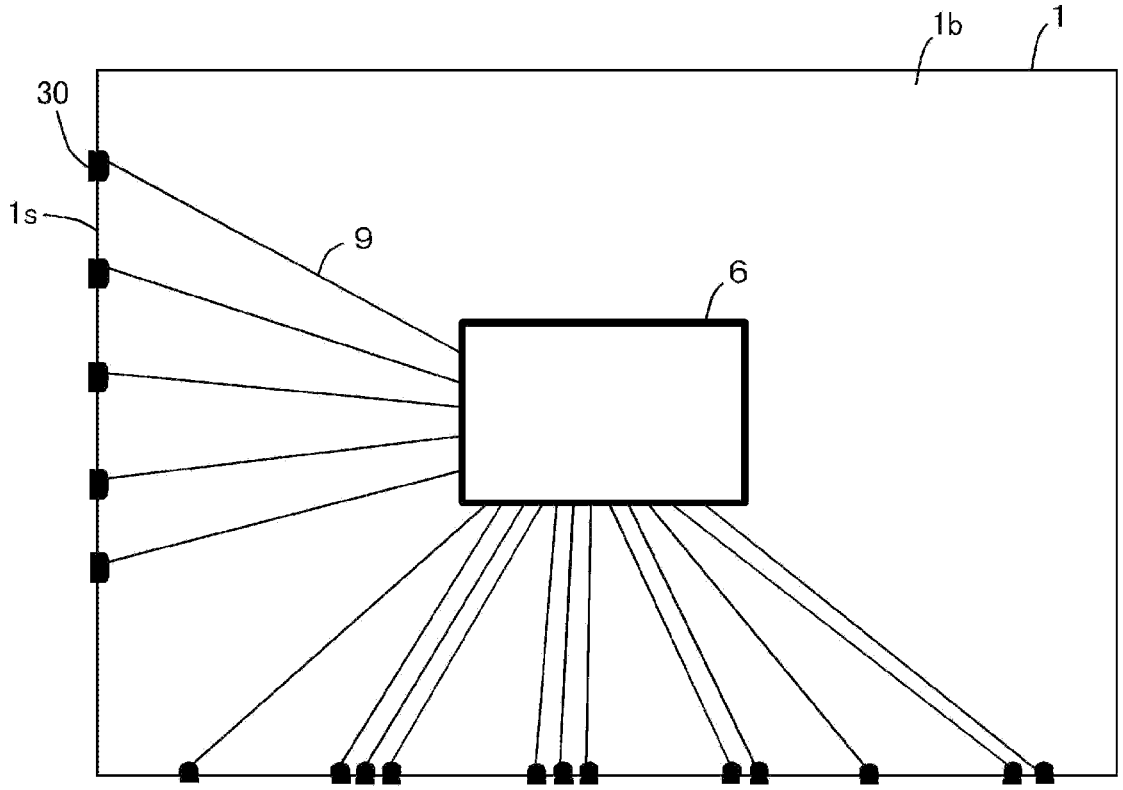
FIG. 8 is a plan view of a driver and back wiring located on an opposite surface of a light emitter board according to another embodiment of the present disclosure.

In the light emitter board according to the present embodiment, the deviation of the measured light intensity within a range of 10% from 100% of the value of the reference light intensity is determined to be within the allowable range. In FIG. 7B, the plot 61*a* is voltage-emission correlation data for a measured light intensity deviating from the reference light intensity by +10%, and the plot 61*b* is voltage-emission correlation data for a measured light intensity deviating from the reference light intensity by −10%. The degree of deviation is not limited to the above range, but can be specified variously based on, for example, the allowable range of the intended display quality and degradation of the light emitters over time.

In FIG. 6A, the storage 33*a* is inside the pixel unit 15. In FIG. 6B, the storage 33*a* is outside the pixel unit 15 or at the periphery of the effective area (display area). When the storage 33*a* has, for example, a large memory capacity, the storage 33*a* is located as in the structure in FIG. 6B to avoid an excessively large pixel unit 15.

The light emitter board according to one or more embodiments may include the switch controller 27, 28, 29, or 33 in the pixel unit 15. This structure allows more prompt switching of the primarily driven light emitter from the first light emitter 14*a* to the second light emitter 14*b*, thus removing emission faults further immediately. When the switch controller 27, 28, 29, or 33 is at the periphery of the effective area other than in the pixel unit 15, the light emitter board may be larger. However, the light emitter board with the above structure is smaller and avoids such an issue.

A light emitter board according to another embodiment includes a substrate 1 having a mount surface 1*a* on which a first light emitter 14*a* and a second light emitter 14*b* are mountable, and at least one pixel unit 15 located on the mount surface 1*a* and including a drive circuit 32, a first drive line 25*a*, and a second drive line 25*b*. The first drive line 25*a* and the second drive line 25*b* are connected in parallel to the drive circuit 32. The first drive line 25*a* is a primary line to primarily drive the first light emitter 14*a*, and the second drive line 25*b* is a redundant line to redundantly drive the second light emitter 14*b*. The light emitter board also includes a switch unit that places one of the first drive line 25*a* or the second drive line 25*b* in a conductive state and places the other of the first drive line 25*a* or the second drive line 25*b* in a nonconductive state, and a switch controller that controls the switch unit. This structure also provides the same effects as the structures described above.

The switch unit may include a single switch that switches the direction of a signal transmission path to one of the two directions, or may include two switches including the first switch 26*a* and the second switch 26*b* shown in FIG. 2. The switch controller is connected to the switch unit to control switching of the switch unit.

Figure 12:
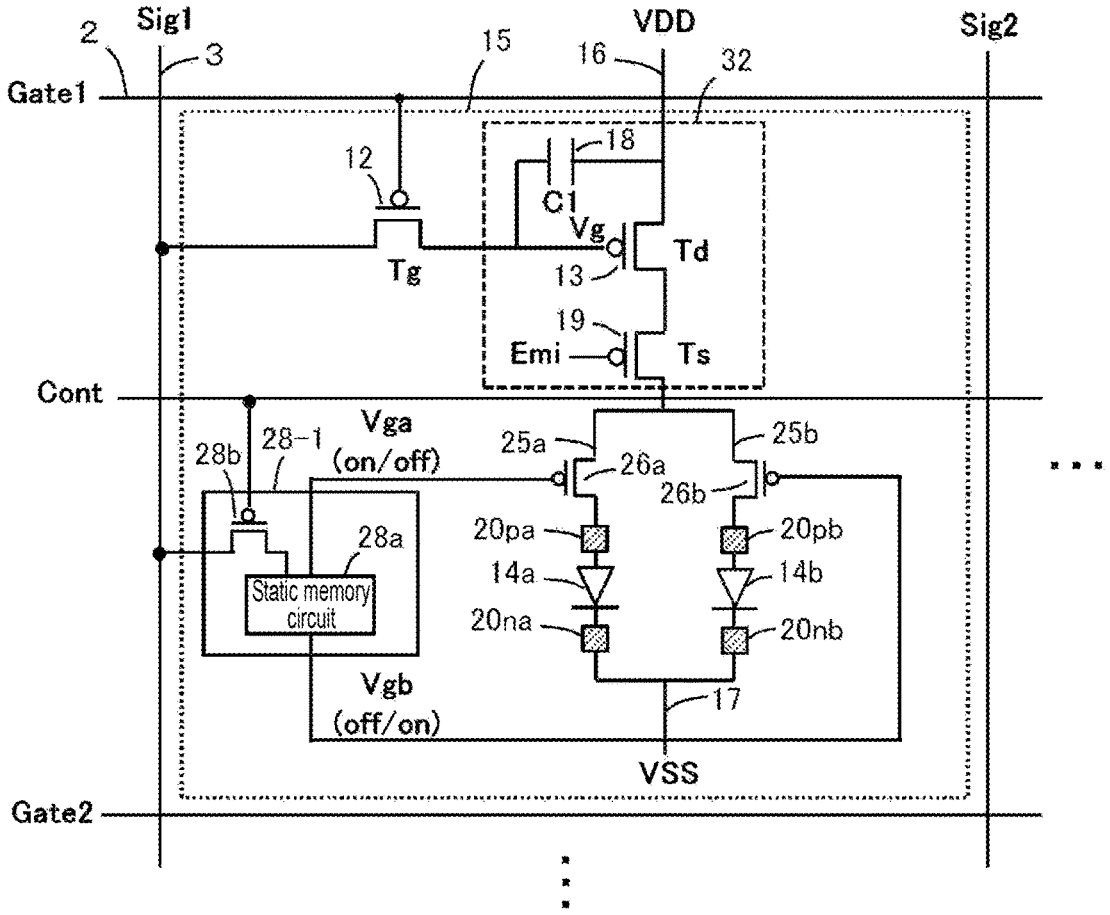
FIG. 12 is a circuit diagram of a pixel unit included in a light emitter board according to another embodiment of the present disclosure.

As shown in FIGS. 2 and 12, the switch unit and the switch controller may be included in the pixel unit 15. The switch unit and the switch controller within the pixel unit 15 allow more prompt switching of the primarily driven light emitter from the first light emitter 14*a* to the second light emitter 14*b*, thus removing emission faults further immediately.

As shown in FIGS. 14A to 17, multiple pixel units 15 may be arranged in a matrix. The first switch 26*a* and the second switch 26*b* as the switch unit may be included in each pixel unit 15. The static memory circuit 28G or 28S as the switch controller may correspond to at least one of multiple pixel units 15*ml* to 15*mn* arranged in a row direction or multiple pixel units 151*n* to 15*mn* arranged in a column direction. The light emitter board with this structure can include far fewer switch controllers. The resultant light emitter board is thus smaller and has a simpler circuit structure, having lower power consumption.

For example, one static memory circuit 28G as the switch controller may correspond to one row including the multiple pixel units 15*ml* to 15*mn* arranged in the row direction. In this case, the light emitter board including n rows (where n is an integer of 2 or more) may include n static memory circuits 28G. One static memory circuit 28G may correspond to multiple rows. One static memory circuit 28G may correspond to each set of multiple rows. One static memory circuit 28G may correspond to all the rows.

For example, one static memory circuit 28S as the switch controller may correspond to one column including the multiple pixel units 151*n* to 15*mn* arranged in the column direction. In this case, the light emitter board including m columns (where m is an integer of 2 or more) includes m static memory circuits 28S. One static memory circuit 28S may correspond to multiple columns. One static memory circuit 28S may correspond to each set of multiple columns. One static memory circuit 28S may correspond to all the columns.

Each pixel unit 15 may include one switch controller.

Figure 13A:
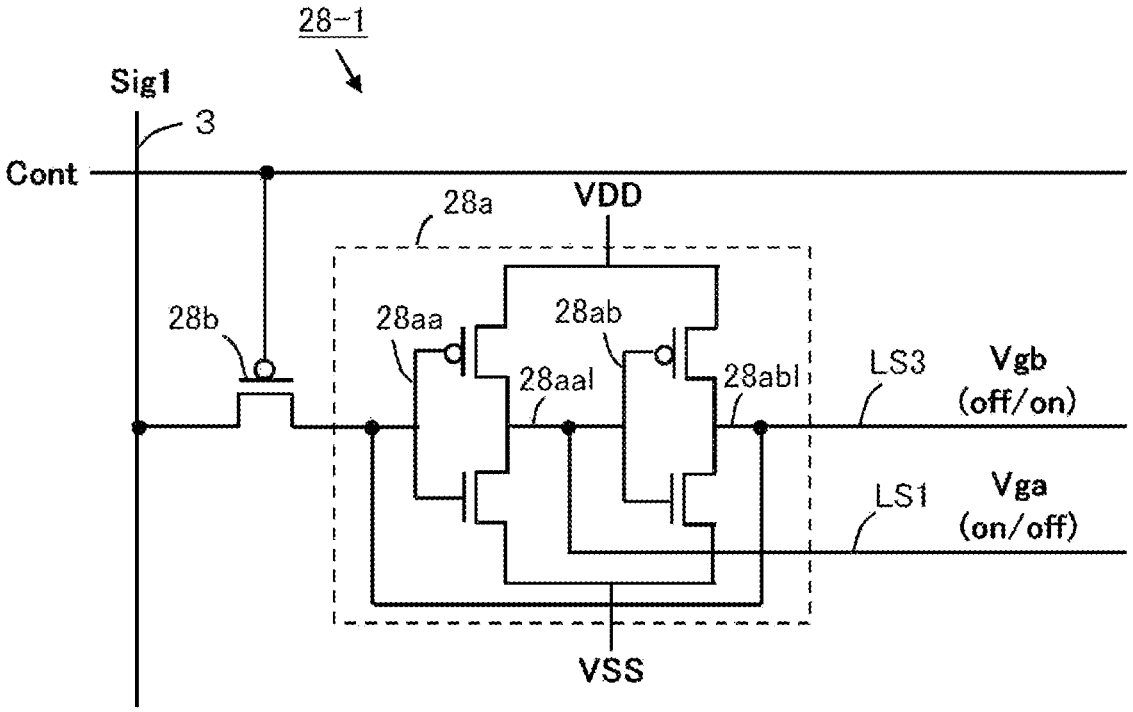
FIG. 13A is a circuit diagram of an example static memory circuit as a switch controller included in the light emitter board in FIG. 12.
Figure 13B:
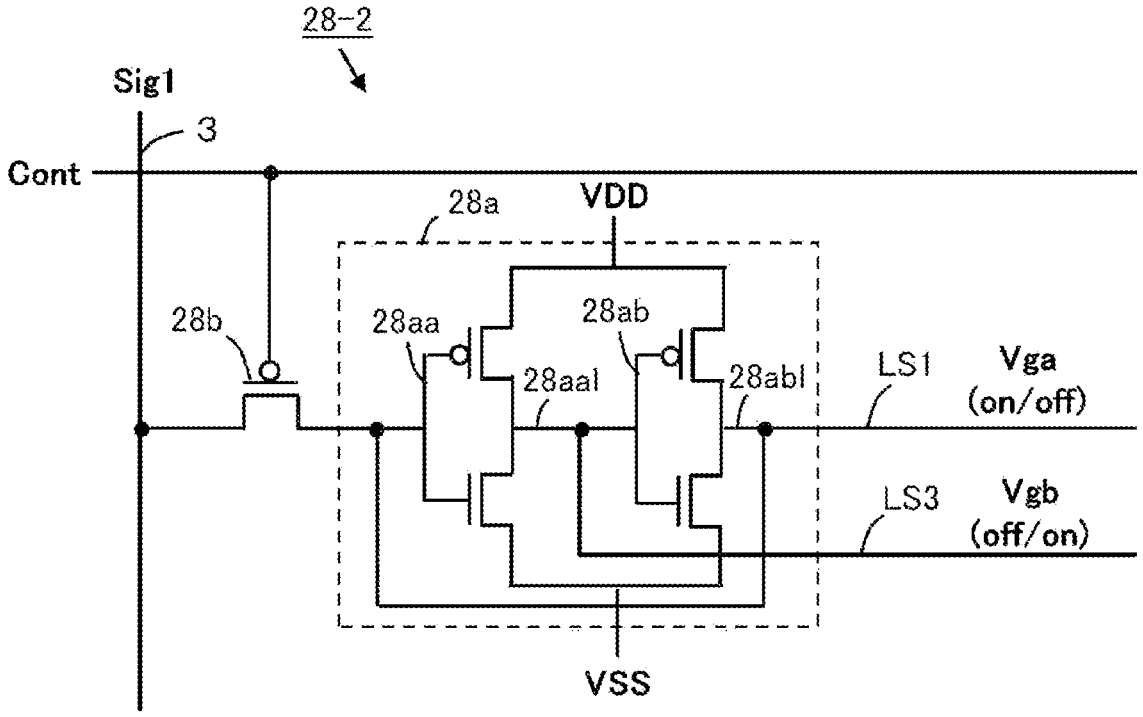
FIG. 13B is a circuit diagram of an example static memory circuit as a switch controller included in the light emitter board in FIG. 12.

As shown in FIGS. 13A and 13B, the switch controller may be a static memory circuit 28-1 or 28-2 that includes a first inverter 28*aa* as a first inverter logic circuit and a second inverter 28*ab* as a second inverter logic circuit connected in series to and downstream from the first inverter 28*aa*. The first switch 26*a* and the second switch 26*b* as the switch unit may be connected in parallel to the first inverter 28*aa* and the second inverter 28*ab*. In other words, the switch unit including the first switch 26*a* and the second switch 26*b* is connected in parallel to the first inverter 28*aa* and the second inverter 28*ab*. The switch unit is thus controllable by the static memory circuit 28-1 or 28-2 alone. The resultant light emitter board thus has a simpler circuit structure with low power consumption.

In the above structure, the static memory circuit 28-1 or 28-2 as the switch controller performs either a first switch control operation to control the first drive line 25*a* to be conductive or nonconductive with a first output signal (Vga in FIG. 13A) from the first inverter 28*aa* and to control the second drive line 25*b* to be conductive or nonconductive with a second output signal (Vgb in FIG. 13A) from the second inverter 28*ab* or a second switch control operation to control the first drive line 25*a* to be conductive or nonconductive with a second output signal (Vga in FIG. 13B) and to control the second drive line 25*b* to be conductive or nonconductive with a first output signal (Vgb in FIG. 13B).

As shown in FIGS. 4A and 4B, the switch controller 28 may include the static memory circuit 28*a* and the inverter 28*c* as an inverter logic circuit connected in parallel to and downstream from the static memory circuit 28*a*. The first switch 26*a* and the second switch 26*b* as a switch unit may be connected in parallel to the static memory circuit 28*a* and the inverter 28*c*. In other words, the switch unit including the first switch 26*a* and the second switch 26*b* is connected in parallel to the static memory circuit 28*a* and the inverter 28*c*. This structure allows the static memory circuit 28*a* to operate stably, thus allowing stable switch control. More specifically, a branch line connected to the output line of the first inverter 28*aa* to derive an inverted signal may lower the electric potential of the inverted signal, thus causing the second inverter 28*ab* to operate unstably. The above structure eliminates such an issue.

In the above structure, the static memory circuit 28*a* and the inverter 28*c* together as the switch controller 28 perform either a first switch control operation to control the first drive line 25*a* to be conductive or nonconductive with a first output signal (Vga in FIGS. 4A and 4B) from the static memory circuit 28*a* and to control the second drive line 25*b* to be conductive or nonconductive with a second output signal (Vgb in FIGS. 4A and 4B) from the inverter 28*c* or a second switch control operation to control the first drive line 25*a* to be conductive or nonconductive with the second output signal (Vgb) and to control the second drive line 25*b* to be conductive or nonconductive with the first output signal (Vga).

FIGS. 12 to 17 each show a light emitter board according to another embodiment of the present disclosure. As shown in FIGS. 12, 13A, and 13B, the switch controller 28-1 or 28-2 includes the static memory circuit 28*a* that includes the first inverter 28*aa* as the first inverter logic circuit and the second inverter 28*ab* as the second inverter logic circuit connected in series to and downstream from the first inverter 28*aa*. The static memory circuit 28*a* includes either a first connection configuration in which the first switch 26*a* is connected to a first output line 28*aal* of the first inverter 28*aa* and the second switch 26*b* is connected to a second output line 28*abl* of the second inverter 28*ab* (shown in FIG. 13A) or a second connection configuration in which the first switch 26*a* is connected to the second output line 28*abl* of the second inverter 28*ab* and the second switch 26*b* is connected to the first output line 28*aal* of the first inverter 28*aa* (shown in FIG. 13B).

In this example, the static memory circuit 28*a* can retain the received high- or low-level signal as an output signal, thus easily maintaining a drive mode in which the first light emitter 14*a* is primarily driven and the second light emitter 14*b* is undriven. The static memory circuit 28*a* also easily maintains the opposite drive mode. The structure with the static memory circuit 28*a* eliminates the inverter logic circuit, simplifying the circuit structure.

In the structure in FIGS. 13A and 13B, the first connection line LS1 connects the static memory circuit 28*a* to the first switch 26*a*, and a third connection line LS3 connects the static memory circuit 28*a* to the second switch 26*b*.

In FIG. 13A, the first connection line LS1 is connected to the first output line 28*aal*. Thus, the output (e.g., low-level signal) from the first inverter 28*aa* input into the gate electrode of the first switch 26*a* places the first switch 26*a* in a primarily on-state, placing the first light emitter 14*a* in a primarily activated state. The third connection line LS3 is connected to the second output line 28*abl*. Thus, the output (e.g., high-level signal) from the second inverter 28*ab* input into the gate electrode of the second switch 26*b* places the second switch 26*b* in a primarily off-state, placing the second light emitter 14*b* in a primarily deactivated state. For any fault such as an abnormal emission in the first light emitter 14*a*, the output from the first inverter 28*aa* is set to a high-level signal (off-signal) to place the first switch 26*a* in a primarily off-state, and the output from the second inverter 28*ab* is set to a low-level signal (on-signal) to place the second switch 26*b* in a primarily on-state. This switching operation is performed in response to the signal (high- or low-level signal) input into the switch 28*b* through the emission control signal line (Sig1) 3.

In FIG. 13B, the first connection line LS1 is connected to the second output line 28*abl*. Thus, the output (e.g., low-level signal) from the second inverter 28*ab* input into the gate electrode of the first switch 26*a* places the first switch 26*a* in a primarily on-state, placing the first light emitter 14*a* in a primarily activated state. The third connection line LS3 is connected to the first output line 28*aal*. Thus, the output (e.g., high-level signal) from the first inverter 28*aa* input into the gate electrode of the second switch 26*b* places the second switch 26*b* in a primarily off-state, placing the second light emitter 14*b* in a primarily deactivated state. For any fault such as an abnormal emission in the first light emitter 14*a*, the output from the second inverter 28*ab* is set to a high-level signal (off-signal) to place the first switch 26*a* in a primarily off-state, and the output from the first inverter 28*aa* is set to a low-level signal (on-signal) to place the second switch 26*b* in a primarily on-state. This switching operation is performed in response to the signal (low- or high-level signal) input into the switch 28*b* through the emission control signal line (Sig1) 3.

Figure 14A:
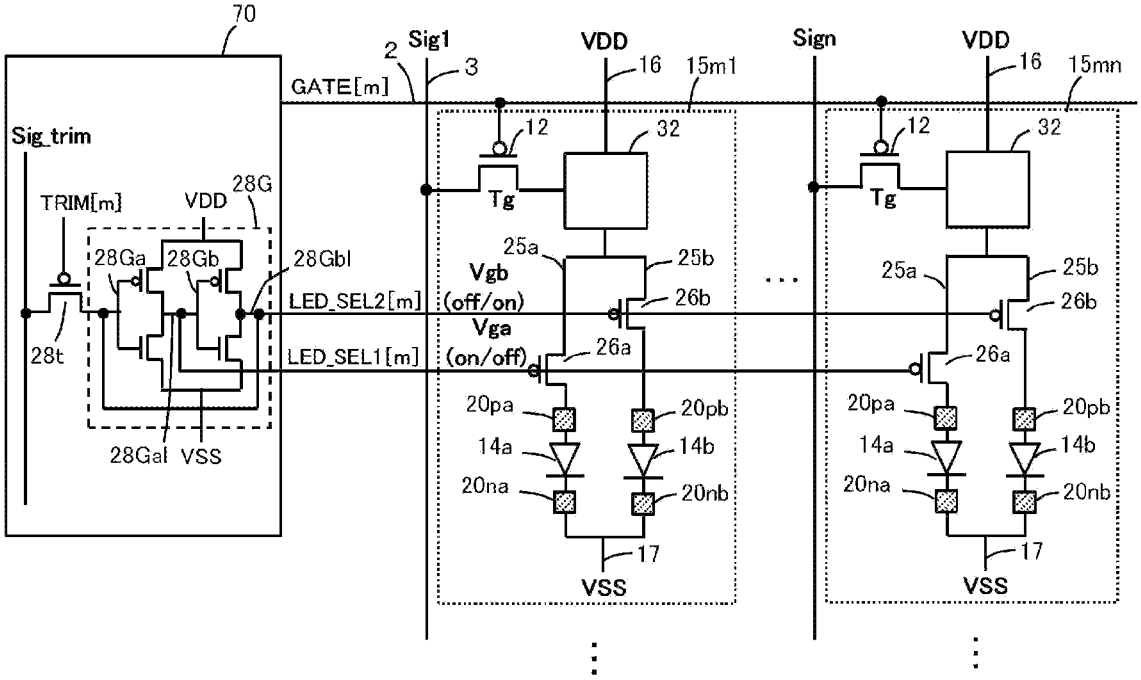
FIG. 14A is a circuit diagram of a light emitter board according to another embodiment of the present disclosure, showing one static memory circuit corresponding to multiple pixel units arranged in one row in a row direction.
Figure 14B:
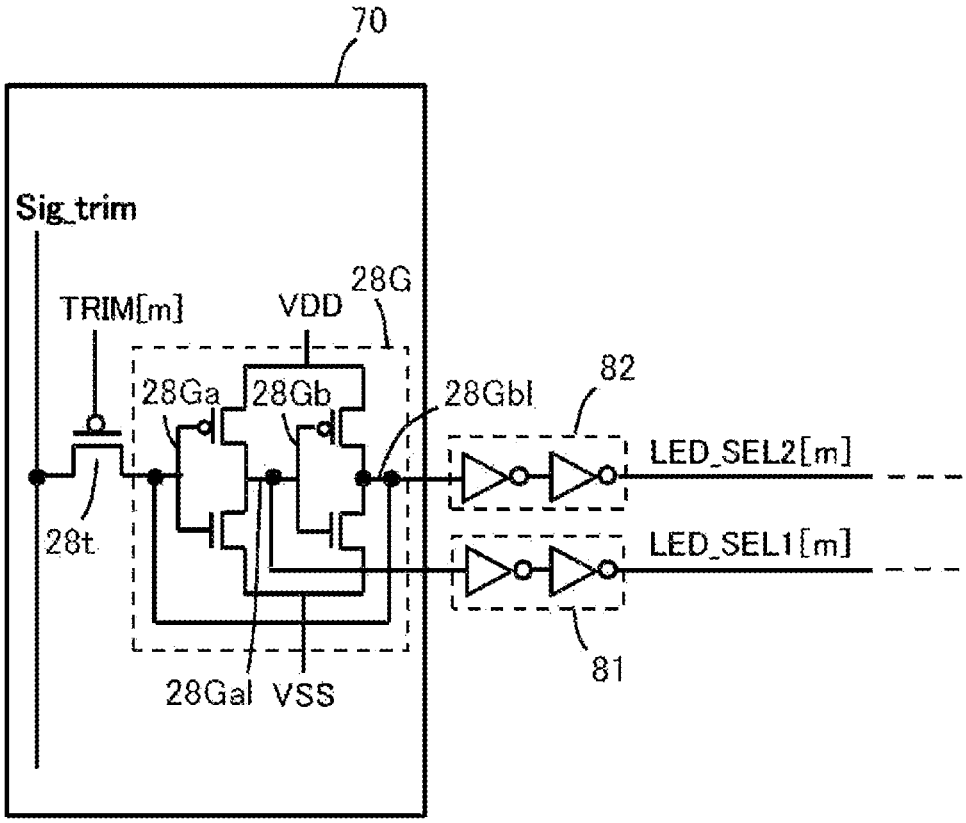
FIG. 14B is a circuit diagram of a light emitter board according to another embodiment of the present disclosure, showing one static memory circuit corresponding to multiple pixel units arranged in one row in a row direction.

FIGS. 14A and 14B each are a circuit diagram of a light emitter board according to another embodiment, showing one static memory circuit 28G corresponding to the multiple pixel units 15*ml* to 15*mn* arranged in the row direction in one row (GATE[m], where m is a natural number indicating that the row is the m-th row). As shown in FIG. 14A, each first switch 26*a* is connected to a first output line 28Gal of a first inverter 28Ga, and each second switch 26*b* is connected to a second output line 28Gbl of a second inverter 28Gb. The output from the first inverter 28Ga (e.g., low-level signal, LED_SEL1[*m*]) is input into the gate electrode of the first switch 26*a* in each of n pixel units 15*ml* to 15*mn* (n is an integer of 2 or more), placing each first switch 26*a* in a primarily on-state and thus placing each first light emitter 14*a* in a primarily activated state. The output (e.g., high-level signa, LED_SEL2[*m*]) from the second inverter 28Gb is input into the gate electrode of each second switch 26*b*, placing the second switch 26*b* in a primarily off-state and thus placing the second light emitter 14*b* in a primarily deactivated state. For any fault such as an abnormal emission in at least one of n first light emitters 14*a*, the output from the first inverter 28Ga is set to a high-level signal (off-signal) to place each first switch 26*a* in a primarily off-state, and the output from the second inverter 28Gb is set to a low-level signal (on-signal) to place each second switch 26*b* in a primarily on-state. This switching operation is performed in response to an emission adjusting signal (high- or low-level signal) input into a switch 28*t* through an emission adjusting signal line (Sig_trim). The switch 28*t* is turned on or off with a gate adjusting signal (TRIM[m]) input into its gate electrode. The static memory circuit 28G and the switch 28*t* may be included in a gate signal line drive (gate driver) 70.

As shown in FIG. 14B, a branch line from the first output line 28Gal may be connected to a buffer circuit 81, through which the output from the first inverter 28Ga (e.g., low-level signal, LED_SEL1[*m*]) is input into the gate electrode of the first switch 26*a* in each of the n pixel units 15*ml* to 15*mn* (n is an integer of 2 or more). The branch line branching from the first output line 28Gal and connected to the gate electrodes of the multiple first switches 26*a* tends to have a fluctuating electrical potential. The above structure reduces the fluctuation in the electric potential of the branch line. Similarly, the second output line 28Gbl may be connected to a buffer circuit 82, through which the output from the second inverter 28Gb (e.g., high-level signal, LED_SEL2[*m*]) is input into the gate electrode of the second switch 26*b* in each of the n pixel units 15*ml* to 15*mn* (n is an integer of 2 or more). The second output line 28Gbl tends to have a fluctuating electrical potential due to the branch line from the first output line 28Gal and due to the connection to the gate electrodes of the multiple second switches 26*b*. The above structure reduces the fluctuation in the electric potential of the second output line 28Gbl.

The buffer circuits 81 and 82 each include two inverters connected in series, but are not limited to this structure.

In the structure in FIGS. 14A and 14B, one static memory circuit 28G may correspond to multiple sets of pixel units 15*ml* to 15*mn*, pixel units 15(*m*+1)l to 15(*m*+1)n, and subsequent pixel units 15 each arranged in a different row in the row direction. In another embodiment, one static memory circuit 28G may correspond to all the pixel units.

Figure 15:
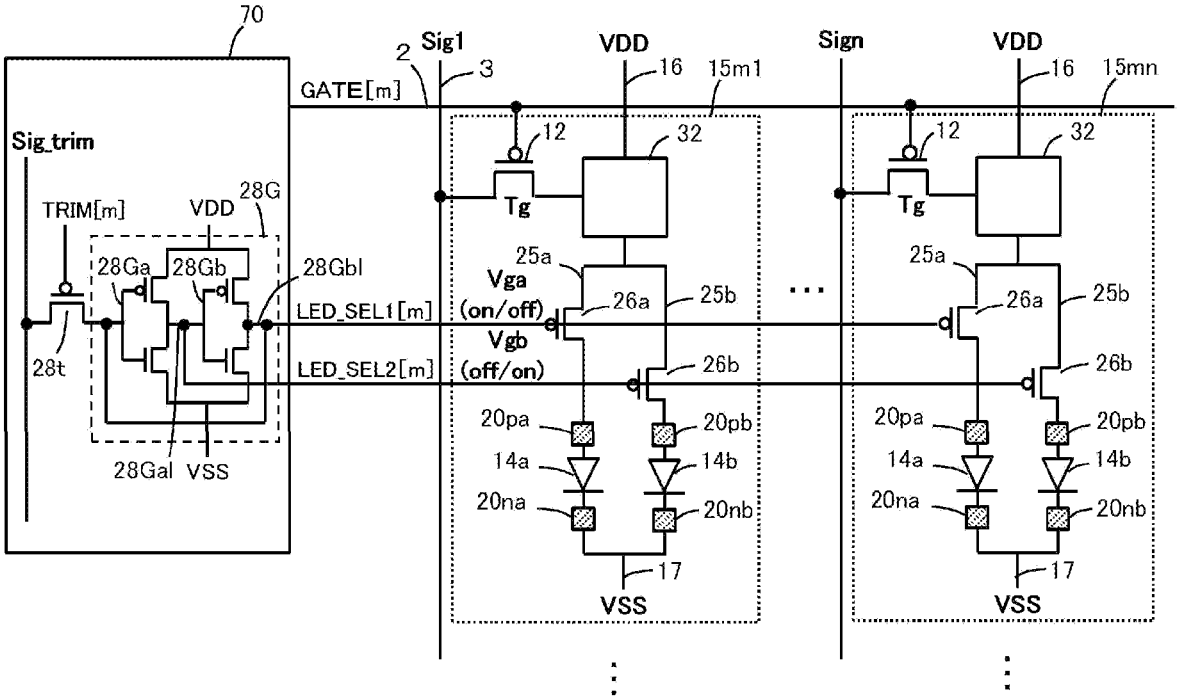
FIG. 15 is a circuit diagram of a light emitter board according to another embodiment of the present disclosure, showing one static memory circuit corresponding to multiple pixel units arranged in one row in a row direction.

FIG. 15 is a circuit diagram of a light emitter board according to another embodiment, showing one static memory circuit 28G corresponding to the multiple pixel units 15*ml* to 15*mn* arranged in the row direction in one row (GATE[m]). Each first switch 26*a* is connected to the second output line 28Gbl of the second inverter 28Gb, and each second switch 26*b* is connected to the first output line 28Gal of the first inverter 28Ga. The output from the second inverter 28Gb (e.g., low-level signal, LED_SEL1[*m*]) is input into the gate electrode of the first switch 26*a* in each of the n pixel units 15*ml* to 15*mn*, placing each first switch 26*a* in a primarily on-state and thus placing each first light emitter 14*a* in a primarily activated state. The output (e.g., high-level signal, LED_SEL2[*m*]) from the first inverter 28Ga is input into the gate electrode of each second switch 26*b*, placing each second switch 26*b* in a primarily off-state and thus placing each second light emitter 14*b* in a primarily deactivated state. For any fault such as an abnormal emission in at least one of n first light emitters 14*a*, the output from the second inverter 28Gb is set to a high-level signal (off-signal) to place each first switch 26*a* in a primarily off-state, and the output from the first inverter 28Ga is set to a low-level signal (on-signal) to place each second switch 26*b* in a primarily on-state. This switching operation is performed in response to an emission adjusting signal (low- or high-level signal) input into the switch 28*t* through the emission adjusting signal line (Sig_trim). The switch 28*t* is turned on or off with a gate adjusting signal (TRIM[m]) input into its gate electrode. The static memory circuit 28G and the switch 28*t* may be included in the gate signal line drive 70.

The structure in FIG. 15 may incorporate the components in FIG. 14B. In other words, the branch line from the first output line 28Gal may be connected to the buffer circuit 82, and the second output line 28Gbl may be connected to the buffer circuit 81.

In the structure in FIG. 15, one static memory circuit 28G may correspond to multiple sets of pixel units 15*ml* to 15*mn*, pixel units 15(*m*+1)l to 15(*m*+1)n, and subsequent pixel units 15 each arranged in a different row in the row direction. In another embodiment, one static memory circuit 28G may correspond to all the pixel units.

Figure 16A:
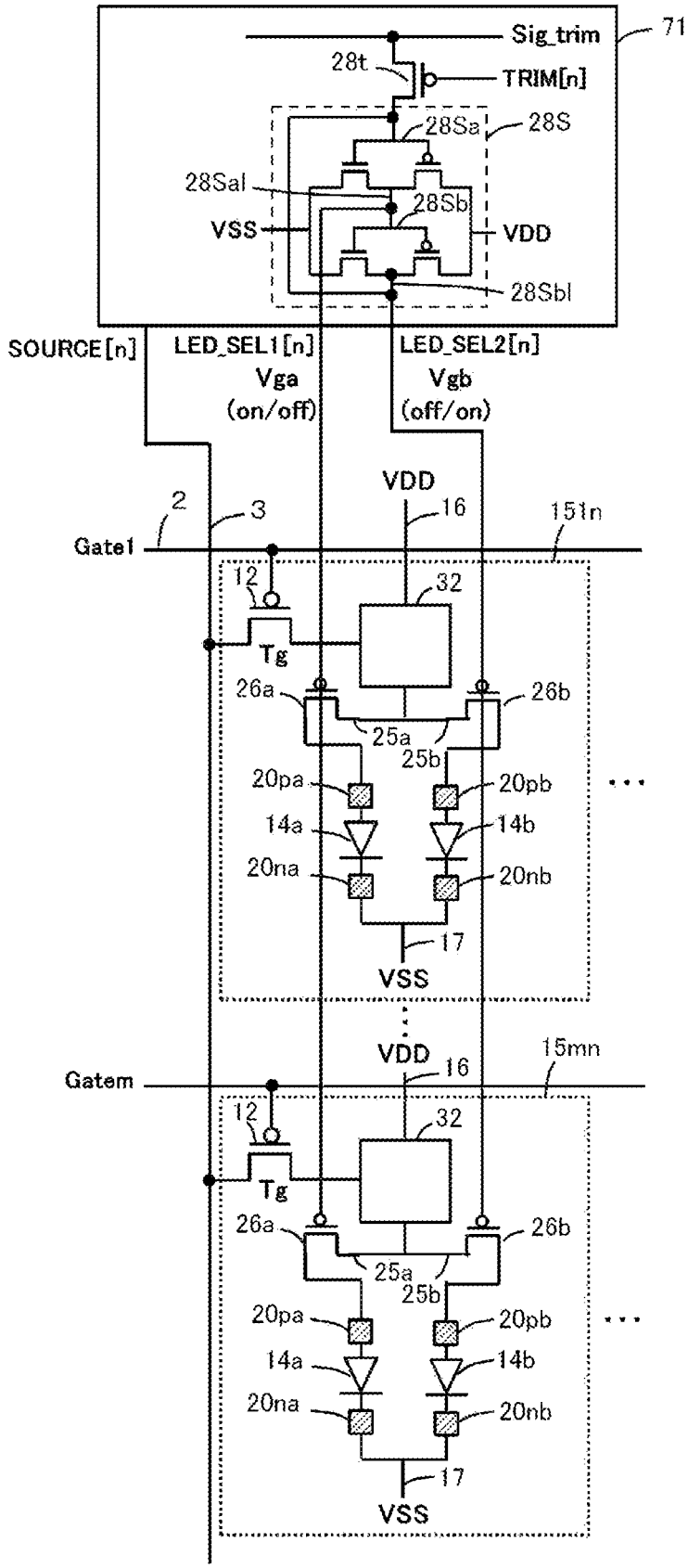
FIG. 16A is a circuit diagram of a light emitter board according to another embodiment of the present disclosure, showing one static memory circuit corresponding to multiple pixel units arranged in one column in a column direction.
Figure 16B:
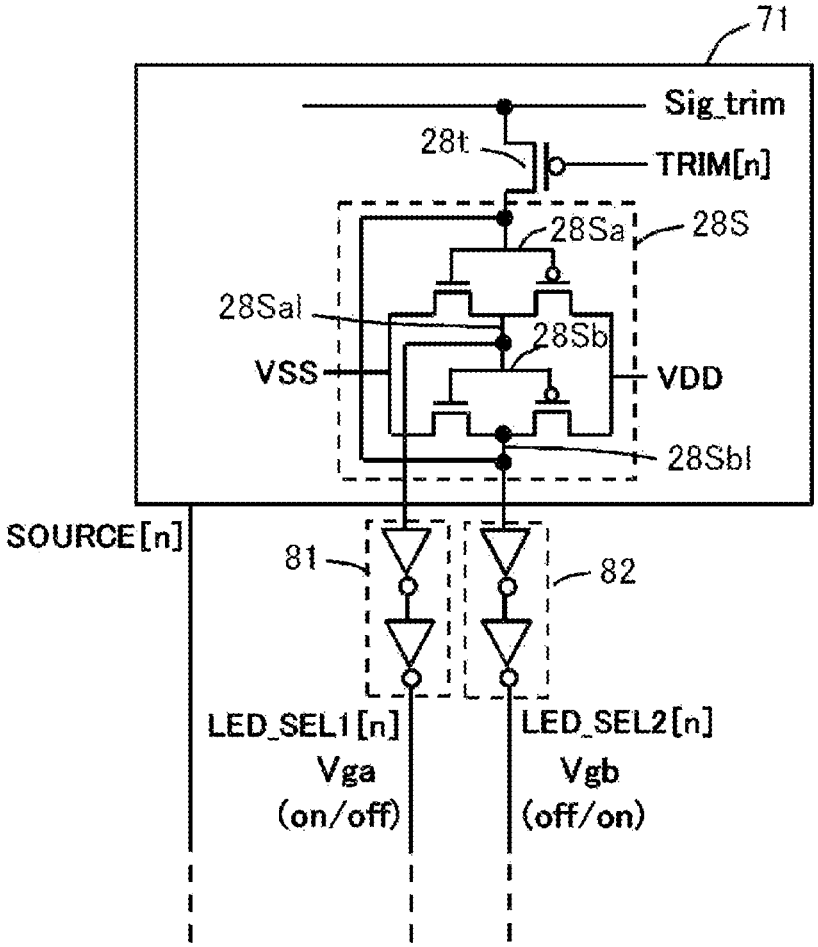
FIG. 16B is a circuit diagram of a light emitter board according to another embodiment of the present disclosure, showing one static memory circuit corresponding to multiple pixel units arranged in one column in a column direction.

FIGS. 16A and 16B each are a circuit diagram of a light emitter board according to another embodiment, showing one static memory circuit 28S corresponding to the multiple pixel units 151*n* to 15*mn* arranged in the column direction in one column (SOURCE[n]). As shown in FIG. 16A, each first switch 26*a* is connected to a first output line 28Sal of a first inverter 28Sa, and each second switch 26*b* is connected to a second output line 28Sbl of a second inverter 28Sb. The output from the first inverter 28Sa (e.g., low-level signal, LED_SEL1[*n*]) is input into the gate electrode of the first switch 26*a* in each of n pixel units 151*n* to 15*mn*, placing each first switch 26*a* in a primarily on-state and thus placing each first light emitter 14*a* in a primarily activated state. The output (e.g., high-level signal, LED_SEL2[*n*]) from the second inverter 28Sb is input into the gate electrode of each second switch 26*b*, placing each second switch 26*b* in a primarily off-state and thus placing each second light emitter 14*b* in a primarily deactivated state. For any fault such as an abnormal emission in at least one of n first light emitters 14*a*, the output from the first inverter 28Sa is set to a high-level signal (off-signal) to place each first switch 26*a* in a primarily off-state, and the output from the second inverter 28Sb is set to a low-level signal (on-signal) to place each second switch 26*b* in a primarily on-state. This switching operation is performed in response to an emission adjusting signal (low- or high-level signal) input into the switch 28*t* through the emission adjusting signal line (Sig_trim). The switch 28*t* is turned on or off with a gate adjusting signal (TRIM[n]) input into its gate electrode. The static memory circuit 28S and the switch 28*t* may be included in an image signal line drive (source driver) 71.

As shown in FIG. 16B, a branch line from the first output line 28Sal may be connected to a buffer circuit 81, through which the output from the first inverter 28Sa (e.g., low-level signal, LED_SEL1[*m*]) is input into the gate electrode of the first switch 26*a* in each of the n pixel units 151*n* to 15*mn* (n is an integer of 2 or more). This structure provides the same effects as described above, or reduces fluctuation in the electrical potential. The second output line 28Sbl may be connected to a buffer circuit 82, through which the output from the second inverter 28Sb (e.g., high-level signal, LED_SEL2[*m*]) is input into the gate electrode of the second switch 26*b* in each of the n pixel units 151*n* to 15*mn* (n is an integer of 2 or more). This structure provides the same effects as described above, or reduces fluctuation in the electrical potential.

In the structure in FIGS. 16A and 16B, one static memory circuit 28S may correspond to multiple sets of pixel units 151*n* to 15*mn*, pixel units 151(*n*+1) to 15*m*(n+1), and subsequent pixel units 15 each arranged in a different column in the column direction. In another embodiment, one static memory circuit 28S may correspond to all the pixel units.

Figure 17:
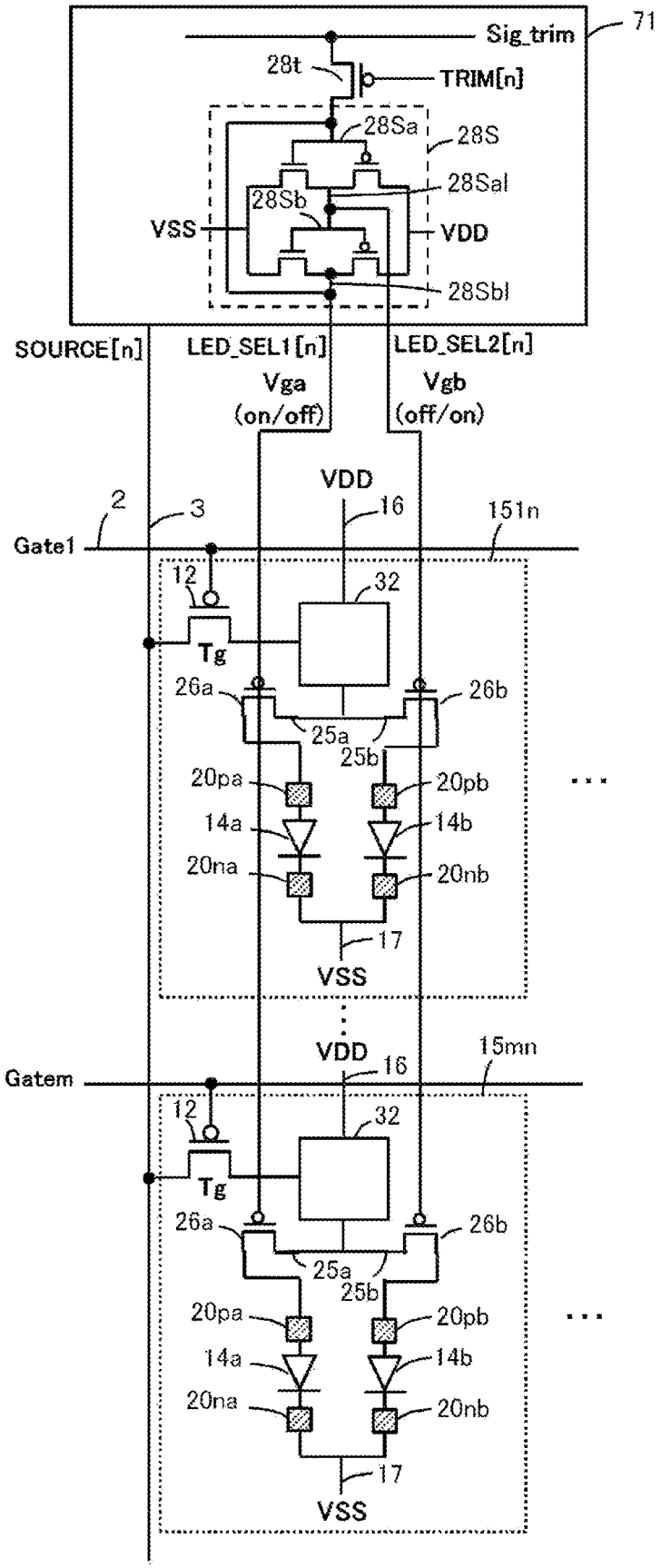
FIG. 17 is a circuit diagram of a light emitter board according to another embodiment of the present disclosure, showing one static memory circuit corresponding to multiple pixel units arranged in one column in a column direction.

FIG. 17 is a circuit diagram of a light emitter board according to another embodiment, showing one static memory circuit 28S corresponding to the multiple pixel units 151*n* to 15*mn* arranged in one column (SOURCE[n]) in the column direction. Each first switch 26*a* is connected to the second output line 28Sbl of the second inverter 28Sb, and each second switch 26*b* is connected to the first output line 28Sal of the first inverter 28Sa. The output from the second inverter 28Sb (e.g., low-level signal, LED_SEL1[*n*]) is input into the gate electrode of the first switch 26*a* in each of the n pixel units 151*n* to 15*mn*, placing each first switch 26*a* in a primarily on-state and thus placing each first light emitter 14*a* in a primarily activated state. The output (e.g., high-level signal, LED_SEL2[*n*]) from the first inverter 28Sa is input into the gate electrode of each second switch 26*b*, placing each second switch 26*b* in a primarily off-state and thus placing each second light emitter 14*b* in a primarily deactivated state. For any fault such as an abnormal emission in at least one of n first light emitters 14*a*, the output from the second inverter 28Sb is set to a high-level signal (off-signal) to place each first switch 26*a* in a primarily off-state, and the output from the first inverter 28Sa is set to a low-level signal (on-signal) to place each second switch 26*b* in a primarily on-state. This switching operation is performed in response to an emission adjusting signal (low- or high-level signal) input into the switch 28*t* through the emission adjusting signal line (Sig_trim). The switch 28*t* is turned on or off with a gate adjusting signal (TRIM[n]) input into its gate electrode. The static memory circuit 28S and the switch 28*t* may be included in the image signal line drive 71.

The structure in FIG. 17 may incorporate the components in FIG. 16B. In other words, the branch line from the first output line 28Sal may be connected to the buffer circuit 82, and the second output line 28Sbl may be connected to the buffer circuit 81.

In the structure in FIG. 17, one static memory circuit 28S may correspond to multiple sets of pixel units 151*n* to 15*mn*, pixel units 151(*n*+1) to 15*m*(n+1), and subsequent pixel units 15 each arranged in a different column in the column direction. In another embodiment, one static memory circuit 28S may correspond to all the pixel units.

A display device according to an embodiment includes any of the light emitter boards described above. The substrate 1 has an opposite surface 1*b* (shown in FIG. 10A) opposite to the mount surface 1*a*, and a side surface is (shown in FIGS. 10A and 10B). The light emitter board includes side wiring 30 (shown in FIGS. 10A and 10B) on the side surface Is, and a driver 6 (shown in FIG. 8) on the opposite surface 1*b*. The first light emitters 14*a* and the second light emitters 14*b* are connected to the driver 6 with the side wiring is. This structure effectively reduces the pixel units 15 having display failures. This structure also prevents the drive signal line drive (emission control signal line drive) from becoming complicated and thus from increasing power consumption. The structure can also avoid overcurrent caused by the switch controller flowing into the second light emitter 14*b* as in the known structure, and thus avoids a shorter service life of the second light emitter 14*b*.

The driver 6 may include driving elements such as ICs and LSI circuits mounted by chip on glass or may be a circuit board on which driving elements are mounted. The driver 6 may also be a thin film circuit including, for example, a TFT that includes a semiconductor layer including low temperature polycrystalline silicon (LTPS) formed directly on the opposite surface 1*b* of the glass substrate 1 by a thin film formation method such as CVD.

The side wiring 30 may be formed from a conductive paste including conductive particles such as silver (Ag), copper (Cu), aluminum (Al), and stainless steel, an uncured resin component, an alcohol solvent, and water. The conductive paste may be cured by heating, photocuring using ultraviolet ray irradiation, or combination of photocuring and heating. The side wiring 30 may also be formed by a thin film formation method such as plating, vapor deposition, and CVD. The substrate 1 may have a groove on the side surface is to receive the side wiring 30. This allows the conductive paste to be easily received in the groove or in an intended portion on the side surface Is.

The display device according to the embodiment may include multiple substrates 1 each including multiple light emitters. The multiple substrates 1 may be arranged in a grid on the same plane. The substrates 1 may be connected (tiled) together with their side surfaces bonded with, for example, an adhesive. The display device can thus be composite and large, forming a multi-display.

The display device according to the embodiment may form a light-emitting device. The light-emitting device can be used as, for example, a printer head for an image formation device and other devices, an illumination device, a signboard, and a notice board.

The method for repairing the display device according to an embodiment includes primarily driving the first light emitters 14*a* each connected to the first positive electrode pad 20*pa* and the first negative electrode pad 20*na* on the mount surface 1*a* of the substrate 1, and upon detection of an abnormal current or an abnormal emission in a first light emitter 14*a*, connecting a second light emitter 14*b* to the second positive electrode pad 20*pb* and the second negative electrode pad 20*nb* on the mount surface 1*a* of the substrate 1, and deactivating the first drive line 25*a* and activating the second drive line 25*b*. This structure eliminates connection of the redundant second light emitters 14*b* while the first light emitters 14*a* remain in a primarily activated state. Thus, a display device including many light emitters can be fabricated at a low cost, without mounting numerous light emitters including the light emitters for redundant driving.

The light emitter board and the display device according to the present disclosure are not limited to the above embodiments and may include design alterations and improvements as appropriate. For example, the substrate 1 may be non-translucent, and may be a glass substrate colored in black, gray, or other colors, or a glass substrate including frosted glass.

The embodiments may be implemented in the forms described below.

A light emitter board according to one or more embodiments of the present disclosure includes a substrate having a mount surface on which a first light emitter and a second light emitter are mountable, and at least one pixel unit located on the mount surface and including a drive circuit, a first drive line, and a second drive line. The first drive line and the second drive line are connected in parallel to the drive circuit. The first drive line is a primary line, and the second drive line is a redundant line. The light emitter board also includes, on the mount surface, a first positive electrode pad and a first negative electrode pad connectable to the first light emitter, and a second positive electrode pad and a second negative electrode pad connectable to the second light emitter. One of the first positive electrode pad or the first negative electrode pad is connected to the first drive line, and one of the second positive electrode pad or the second negative electrode pad is connected to the second drive line.

The light emitter board according to one or more embodiments of the present disclosure may further include a first switch located on the first drive line to activate and deactivate the first drive line, and a second switch located on the second drive line to activate and deactivate the second drive line.

The light emitter board according to one or more embodiments of the present disclosure may further include a switch controller that controls one of the first switch or the second switch to be closed and another of the first switch or the second switch to be open.

In the light emitter board according to one or more embodiments of the present disclosure, the switch controller may include a storage that stores voltage-current correlation data for a drive voltage and a drive current of a reference light emitter, and an abnormal current detector that detects an abnormality in a current through the first light emitter by referencing the voltage-current correlation data. The switch controller may control the first switch to be open and the second switch to be closed upon detecting an abnormality in the current through the first light emitter.

In the light emitter board according to one or more embodiments of the present disclosure, the switch controller may include a storage that stores voltage-emission correlation data for a drive voltage and a light intensity of a reference light emitter, and an abnormal emission detector that detects an abnormality in emission from the first light emitter by referencing the voltage-emission correlation data. The switch controller may control the first switch to be open and the second switch to be closed upon detecting an abnormality in the emission from the first light emitter.

In the light emitter board according to one or more embodiments of the present disclosure, the switch controller may be included in the at least one pixel unit.

In the light emitter board according to one or more embodiments of the present disclosure, the at least one pixel unit may include a plurality of pixel units arranged in a matrix. Each pixel unit of the plurality of pixel units may include the switch unit. There are multiple switch units. The switch controller may correspond to at least one of a first set of the plurality of pixel units arranged in a row direction or a second set of the plurality of pixel units arranged in a column direction.

In the light emitter board according to one or more embodiments of the present disclosure, the first light emitter and the second light emitter each may include a micro-light-emitting diode.

A light emitter board according to one or more embodiments of the present disclosure includes a substrate having a mount surface on which a first light emitter and a second light emitter are mountable, and at least one pixel unit located on the mount surface and including a drive circuit, a first drive line, and a second drive line. The first drive line and the second drive line are connected in parallel to the drive circuit. The first drive line is a primary line to primarily drive the first light emitter, and the second drive line is a redundant line to redundantly drive the second light emitter. The light emitter board also includes a switch unit that places one of the first drive line or the second drive line in a conductive state and another of the first drive line or the second drive line in a nonconductive state, and a switch controller that controls the switch unit.

In the light emitter board according to one or more embodiments of the present disclosure, the switch unit and the switch controller may be included in the at least one pixel unit.

In the light emitter board according to one or more embodiments of the present disclosure, the at least one pixel unit may include a plurality of pixel units arranged in a matrix. Each pixel unit of the plurality of pixel units may include the switch unit. There are multiple switch units. The switch controller may correspond to at least one of a first set of the plurality of pixel units arranged in a row direction or a second set of the plurality of pixel units arranged in a column direction.

In the light emitter board according to one or more embodiments of the present disclosure, the switch controller may include a static memory circuit including a first inverter logic circuit and a second inverter logic circuit connected in series to and downstream from the first inverter logic circuit. The switch unit may be connected in parallel to the first inverter logic circuit and the second inverter logic circuit.

In the light emitter board according to one or more embodiments of the present disclosure, the switch controller may include a static memory circuit and an inverter logic circuit connected in parallel to and downstream from the static memory circuit. The switch unit may be connected in parallel to the static memory circuit and the inverter logic circuit.

A display device according to one or more embodiments of the present disclosure is a display device including the light emitter board according to one or more embodiments of the present disclosure. The substrate has an opposite surface opposite to the mount surface, and a side surface. The light emitter board includes side wiring on the side surface and a driver on the opposite surface. The first light emitter and the second light emitter are connected to the driver with the side wiring.

A method for repairing a display device according to one or more embodiments of the present disclosure is a method for repairing the display device according to one or more embodiments of the present disclosure. The method includes driving primarily the first light emitter mounted on the mount surface of the substrate, and mounting, upon detection of an abnormal current or an abnormal emission in the first light emitter, the second light emitter on the mount surface and deactivating the first drive line and activating the second drive line.

The light emitter board according to one or more embodiments of the present disclosure includes a substrate having a mount surface on which a first light emitter and a second light emitter are mountable, and at least one pixel unit located on the mount surface and including a drive circuit, a first drive line, and a second drive line. The first drive line and the second drive line are connected in parallel to the drive circuit. The first drive line is a primary line, and the second drive line is a redundant line. The light emitter board also includes, on the mount surface, a first positive electrode pad and a first negative electrode pad connectable to the first light emitter, and a second positive electrode pad and a second negative electrode pad connectable to the second light emitter. One of the first positive electrode pad or the first negative electrode pad is connected to the first drive line, and one of the second positive electrode pad or the second negative electrode pad is connected to the second drive line. This structure provides the effects described below. The first light emitter conductively connected to the first positive electrode pad and the first negative electrode pad with, for example, solder may have a connection fault, or the first light emitter may be a defective product. In this case, the first drive line may be deactivated (placed in an unused state), and the second light emitter may be connected to the second positive electrode pad and the second negative electrode pad to be activated (placed in a used state). This effectively reduces the pixel units having emission faults or emission failures. The first positive electrode pad and the second positive electrode pad are physically and electrically independent of each other, and the first negative electrode pad and the second negative electrode pad are physically and electrically independent of each other. Such drive systems independent of each other eliminate any further adjustment to the drive signal after the primary light emitter is switched to the second light emitter. This prevents the drive signal line drive (emission control signal line drive) from becoming complicated and thus from increasing power consumption. The structure can also avoid overcurrent flowing into the second light emitter as in the known structure, and can thus avoid a shorter service life of the second light emitter.

The light emitter board according to one or more embodiments of the present disclosure may further include a first switch located on the first drive line to activate and deactivate the first drive line, and a second switch located on the second drive line to activate and deactivate the second drive line. This structure facilitates switching between a drive mode in which the first drive line is activated and the second drive line is deactivated and a drive mode in which the first drive line is deactivated and the second drive line is activated.

The light emitter board according to one or more embodiments of the present disclosure may further include a switch controller that controls one of the first switch or the second switch to be closed and another of the first switch or the second switch to be open. This structure facilitates switching between a drive mode in which the first drive line is activated and the second drive line is deactivated and a drive mode in which the first drive line is deactivated and the second drive line is activated. This allows prompt switching of the primarily driven light emitter from the first light emitter to the second light emitter, thus removing emission faults immediately.

In the light emitter board according to one or more embodiments of the present disclosure, the switch controller may include a storage that stores voltage-current correlation data for a drive voltage and a drive current of a reference light emitter, and an abnormal current detector that detects an abnormality in a current through the first light emitter by referencing the voltage-current correlation data. The switch controller may control the first switch to be open and the second switch to be closed upon detecting an abnormality in the current through the first light emitter. This structure allows more automated and accurate detection of emission faults in the first light emitter than in the structure in which the emission state of the first light emitter is detected visually.

In the light emitter board according to one or more embodiments of the present disclosure, the switch controller may include a storage that stores voltage-emission correlation data for a drive voltage and a light intensity of a reference light emitter, and an abnormal emission detector that detects an abnormality in emission from the first light emitter by referencing the voltage-emission correlation data. The switch controller may control the first switch to be open and the second switch to be closed upon detecting an abnormality in the emission from the first light emitter. This structure allows more automated and accurate detection of emission faults in the first light emitter than in the structure in which the emission state of the first light emitter is detected visually.

In the light emitter board according to one or more embodiments of the present disclosure, the switch controller may be included in the at least one pixel unit. This structure allows more prompt switching of the primarily driven light emitter to the second light emitter, thus removing emission faults further immediately. When the switch controller is at the periphery of the pixel unit other than in the pixel unit, the light emitter board may be larger. However, the light emitter board with the above structure is smaller and avoids such an issue.

In the light emitter board according to one or more embodiments of the present disclosure, the at least one pixel unit may include a plurality of pixel units arranged in a matrix. Each pixel unit of the plurality of pixel units may include the switch unit. There are multiple switch units. The switch controller may correspond to at least one of a first set of the plurality of pixel units arranged in a row direction or a second set of the plurality of pixel units arranged in a column direction. The light emitter board with this structure can include far fewer switch controllers. The resultant light emitter board is thus smaller and has a simpler circuit structure, having lower power consumption.

In the light emitter board according to one or more embodiments of the present disclosure, the first light emitter and the second light emitter each may include a micro-light-emitting diode. The micro-LEDs is a small light emitter easily connectable with electrode pads. Thus, a display device including the light emitter board according to one or more embodiments of the present disclosure enables high-quality image display and easy repair of the light emitters.

The light emitter board according to one or more embodiments of the present disclosure includes a substrate having a mount surface on which a first light emitter and a second light emitter are mountable, and at least one pixel unit located on the mount surface and including a drive circuit, a first drive line, and a second drive line. The first drive line and the second drive line are connected in parallel to the drive circuit. The first drive line is a primary line to primarily drive the first light emitter, and the second drive line is a redundant line to redundantly drive the second light emitter. The light emitter board also includes a switch unit that places one of the first drive line or the second drive line in a conductive state and another of the first drive line or the second drive line in a nonconductive state, and a switch controller that controls the switch unit. This structure provides the effects described below. The first light emitter mounted on the mount surface may have a connection fault or the first light emitter may be a defective product. In this case, the first drive line may be deactivated (placed in an unused state) and the second drive line may be activated (placed in a used state). This effectively reduces the pixel units having emission faults or emission failures. The first drive line and the second drive line are physically and electrically independent of each other. Such drive systems independent of each other eliminate any further adjustment to the drive signal after the primarily driven light emitter is switched to the second light emitter. This prevents the drive signal line drive (emission control signal line drive) from becoming complicated and thus from increasing power consumption. The structure can also avoid overcurrent flowing into the second light emitter as in the known structure, and can thus avoid a shorter service life of the second light emitter.

In the light emitter board according to one or more embodiments of the present disclosure, the switch unit and the switch controller may be included in the at least one pixel unit. This structure allows more prompt switching of the primarily driven light emitter to the second light emitter, thus removing emission faults further immediately.

In the light emitter board according to one or more embodiments of the present disclosure, the at least one pixel unit may include a plurality of pixel units arranged in a matrix. Each pixel unit of the plurality of pixel units may include the switch unit. There are multiple switch units. The switch controller may correspond to at least one of a first set of the plurality of pixel units arranged in a row direction or a second set of the plurality of pixel units arranged in a column direction. The light emitter board with this structure can include far fewer switch controllers. The resultant light emitter board is thus smaller and has a simpler circuit structure, having lower power consumption.

In the light emitter board according to one or more embodiments of the present disclosure, the switch controller may include a static memory circuit including a first inverter logic circuit and a second inverter logic circuit connected in series to and downstream from the first inverter logic circuit. The switch unit may be connected in parallel to the first inverter logic circuit and the second inverter logic circuit. The switch unit is thus controllable by the static memory circuit alone. The resultant light emitter board thus has a simpler circuit structure with lower power consumption.

In the light emitter board according to one or more embodiments of the present disclosure, the switch controller may include a static memory circuit and an inverter logic circuit connected in parallel to and downstream from the static memory circuit. The switch unit may be connected in parallel to the static memory circuit and the inverter logic circuit. This structure allows the static memory circuit to operate stably, thus allowing stable switch control.

The display device according to one or more embodiments of the present disclosure is a display device including the light emitter board according to one or more embodiments of the present disclosure. The substrate has an opposite surface opposite to the mount surface, and a side surface. The light emitter board includes side wiring on the side surface and a driver on the opposite surface. The first light emitter and the second light emitter are connected to the driver with the side wiring. The display device with the structure effectively reduces pixel units having display failures. This structure also prevents the drive signal line drive (emission control signal line drive) from becoming complicated and thus from increasing power consumption. The structure can also avoid a shorter service life of the second light emitter.

The method for repairing a display device according to one or more embodiments of the present disclosure is a method for repairing the display device according to one or more embodiments of the present disclosure. The method includes driving primarily the first light emitter mounted on the mount surface of the substrate, and mounting, upon detection of an abnormal current or an abnormal emission in the first light emitter, the second light emitter on the mount surface and deactivating the first drive line and activating the second drive line. The method thus eliminates connection of the redundant second light emitter while the first light emitter remains in a primarily activated state. Thus, a display device including many light emitters can be fabricated at a low cost, without mounting numerous light emitters including the light emitters for redundant driving.

INDUSTRIAL APPLICABILITY

The display device according to one or more embodiments of the present disclosure can be used in various electronic devices. Such electronic devices include composite and large display devices (multi-displays), automobile route guidance systems (car navigation systems), ship route guidance systems, aircraft route guidance systems, smartphones, mobile phones, tablets, personal digital assistants (PDAs), video cameras, digital still cameras, electronic organizers, electronic books, electronic dictionaries, personal computers, copiers, terminals for game devices, television sets, product display tags, price display tags, programmable display devices for industrial use, car audio systems, digital audio players, facsimile machines, printers, automatic teller machines (ATMs), vending machines, head-mounted displays (HMDs), digital display watches, and smartwatches.

The present disclosure may be embodied in various forms without departing from the spirit or the main features of the present disclosure. The embodiments described above are thus merely illustrative in all respects. The scope of the present invention disclosed herein is defined not by the description given above but by the claims. Any modifications and alterations contained in the claims fall within the scope of the present invention disclosed herein.

REFERENCE SIGNS LIST

1 substrate
1*a* mount surface
1*b* opposite surface
1*s* side surface
6 driver
14*a* first light emitter
14*b* second light emitter
15 pixel unit
20*pa* first positive electrode pad
20*na* first negative electrode pad
20*pb* second positive electrode pad
20*nb* second negative electrode pad
25*a* first drive line
25*b* second drive line
26*a* first switch
26*b* second switch
27, 28, 29, 33 switch controller
28*a*, 28G, 28S static memory circuit
28Ga, 28Sa first inverter
28Gal, 28Sal first output line
28Gb, 28Sb second inverter
28Gbl, 28Sbl second output line
30 side wiring
50 voltage-current correlation data
60 voltage-emission correlation data
81, 82 buffer circuit

The invention claimed is:

1. A light emitter board, comprising:

a substrate having a mount surface on which a first light emitter and a second light emitter are mountable;

at least one pixel unit on the mount surface, the at least one pixel unit including a drive circuit, a first drive line, and a second drive line, the first drive line and the second drive line being connected in parallel to the drive circuit, the first drive line being a primary line, the second drive line being a redundant line;

a first positive electrode pad and a first negative electrode pad on the mount surface, the first positive electrode pad and the first negative electrode pad being connectable to the first light emitter, one of the first positive electrode pad or the first negative electrode pad being connected to the first drive line; and a second positive electrode pad and a second negative electrode pad on the mount surface, the second positive electrode pad and the second negative electrode pad being connectable to the second light emitter, one of the second positive electrode pad or the second negative electrode pad being connected to the second drive line, wherein the second positive electrode pad has a greater area than the first positive electrode pad and the second negative pad has a greater area than the first negative electrode pad.

2. The light emitter board according to claim 1, further comprising:

a first switch located on the first drive line to activate and deactivate the first drive line; and a second switch located on the second drive line to activate and deactivate the second drive line.

3. The light emitter board according to claim 2, further comprising:

a switch controller configured to control one of the first switch or the second switch to be closed and another of the first switch or the second switch to be open.

4. The light emitter board according to claim 3, wherein the switch controller includes a storage that stores voltage-current correlation data for a drive voltage and a drive current of a reference light emitter, and an abnormal current detector configured to detect an abnormality in a current through the first light emitter by referencing the voltage-current correlation data, and the switch controller controls the first switch to be open and the second switch to be closed upon detecting an abnormality in the current through the first light emitter.

5. The light emitter board according to claim 3, wherein the switch controller includes a storage that stores voltage-emission correlation data for a drive voltage and a light intensity of a reference light emitter, and an abnormal emission detector configured to detect an abnormality in emission from the first light emitter by referencing the voltage-emission correlation data, and the switch controller controls the first switch to be open and the second switch to be closed upon detecting an abnormality in the emission from the first light emitter.

6. The light emitter board according to claim 3, wherein the switch controller is included in the at least one pixel unit.

7. The light emitter board according to claim 3, wherein the at least one pixel unit comprises a plurality of pixel units arranged in a matrix, each pixel unit of the plurality of pixel units includes a switch unit, and the switch controller corresponds to at least one of a first set of the plurality of pixel units arranged in a row direction or a second set of the plurality of pixel units arranged in a column direction.

8. The light emitter board according to claim 1, wherein the first light emitter and the second light emitter each include a micro-light-emitting diode.

9. A light emitter board, comprising:

a substrate having a mount surface on which a first light emitter and a second light emitter are mountable;

at least one pixel unit on the mount surface, the at least one pixel unit including a drive circuit, a first drive line, and a second drive line, the first drive line and the second drive line being connected in parallel to the drive circuit, the first drive line being a primary line to primarily drive the first light emitter, the second drive line being a redundant line to redundantly drive the second light emitter;

a switch unit configured to place one of the first drive line or the second drive line in a conductive state and another of the first drive line or the second drive line in a nonconductive state; and a switch controller connected to the switch unit, wherein the switch controller includes a static memory circuit including a first inverter logic circuit and a second inverter logic circuit connected in series to and downstream from the first inverter logic circuit, and the switch unit is connected in parallel to the first inverter logic circuit and the second inverter logic circuit.

10. The light emitter board according to claim 9, wherein the switch unit and the switch controller are included in the at least one pixel unit.

11. The light emitter board according to claim 9, wherein the at least one pixel unit comprises a plurality of pixel units arranged in a matrix, each pixel unit of the plurality of pixel units includes the switch unit, and there are multiple switch unites, and the switch controller corresponds to at least one of a first set of the plurality of pixel units arranged in a row direction or a second set of the plurality of pixel units arranged in a column direction.

12. A light emitter board, comprising:

a substrate having a mount surface on which a first light emitter and a second light emitter are mountable;

at least one pixel unit on the mount surface, the at least one pixel unit including a drive circuit, a first drive line, and a second drive line, the first drive line and the second drive line being connected in parallel to the drive circuit, the first drive line being a primary line to primarily drive the first light emitter, the second drive line being a redundant line to redundantly drive the second light emitter;

a switch unit configured to place one of the first drive line or the second drive line in a conductive state and another of the first drive line or the second drive line in a nonconductive state; and a switch controller connected to the switch unit, wherein the switch controller includes a static memory circuit and an inverter logic circuit connected in parallel to and downstream from the static memory circuit, and the switch unit is connected in parallel to the static memory circuit and the inverter logic circuit.

13. A display device, comprising the light emitter board according to claim 1, wherein the substrate has an opposite surface opposite to the mount surface, and a side surface, the light emitter board includes side wiring on the side surface and a driver on the opposite surface, and the first light emitter and the second light emitter are connected to the driver with the side wiring.

14. A method for repairing the display device according to claim 13, the method comprising:

driving primarily the first light emitter mounted on the mount surface of the substrate; and mounting, upon detection of an abnormal current or an abnormal emission in the first light emitter, the second light emitter on the mount surface, and deactivating the first drive line and activating the second drive line.

* * * * *